US009115574B2

(12) United States Patent
Doyle

(10) Patent No.: US 9,115,574 B2
(45) Date of Patent: Aug. 25, 2015

(54) LOW PROFILE ROD PUMPING UNIT WITH PNEUMATIC COUNTERBALANCE FOR THE ACTIVE CONTROL OF THE ROD STRING

(71) Applicant: Lufkin Industries, Inc., Lufkin, TX (US)

(72) Inventor: David W. Doyle, Lufkin, TX (US)

(73) Assignee: LUFKIN INDUSTRIES, LLC, Dallas, TX (US)

( * ) Notice: Subject to any disclaimer, the term of this patent is extended or adjusted under 35 U.S.C. 154(b) by 173 days.

(21) Appl. No.: 13/672,642

(22) Filed: Nov. 8, 2012

(65) Prior Publication Data

US 2013/0306326 A1 Nov. 21, 2013

Related U.S. Application Data

(60) Provisional application No. 61/557,269, filed on Nov. 8, 2011.

(51) Int. Cl.

| | |
|---|---|
| ***E21B 43/12*** | (2006.01) |
| ***F04B 47/02*** | (2006.01) |
| ***F04B 47/04*** | (2006.01) |

(52) U.S. Cl.

CPC ..... *E21B 43/127* (2013.01); *E21B 43/12* (2013.01); *F04B 47/02* (2013.01); *F04B 47/04* (2013.01); *Y10T 74/18182* (2015.01)

(58) Field of Classification Search

USPC ..... 166/369, 68.5; 74/41

See application file for complete search history.

(56) References Cited

U.S. PATENT DOCUMENTS

| | | | | |
|---|---|---|---|---|
| 1,992,393 | A * | 2/1935 | Rawson | 74/41 |
| 2,141,703 | A | 12/1938 | Bays | |
| 2,432,735 | A | 12/1947 | Downing | |
| 2,526,388 | A | 10/1950 | Miller | |
| 5,196,770 | A | 3/1993 | Champs et al. | |
| 5,832,727 | A | 11/1998 | Stanley | |
| 6,213,722 | B1 | 4/2001 | Raos | |
| 7,373,971 | B2 | 5/2008 | Montgomery | |
| 7,748,308 | B2 | 7/2010 | Anderson et al. | |
| 8,082,734 | B2 * | 12/2011 | St. Denis | 60/369 |
| 8,562,308 | B1 * | 10/2013 | Krug et al. | 417/237 |
| 8,668,464 | B2 * | 3/2014 | Kensy et al. | 417/53 |
| 2007/0068399 | A1 * | 3/2007 | Anderson et al. | 100/269.06 |

(Continued)

FOREIGN PATENT DOCUMENTS

WO 2009/052175 A1 4/2009

OTHER PUBLICATIONS

Nickitas-Etienne, A., The International Preliminary Report on Patentability, the International Bureau of WIPO, dated May 22, 2014.

(Continued)

*Primary Examiner* — William P Neuder

(74) *Attorney, Agent, or Firm* — Sutton McAughan Deaver PLLC

(57) ABSTRACT

Adaptable systems for a surface pumping unit that includes a low inertia pumping unit mechanism having a pneumatic counterbalance assembly are described, as well as methods for the use of such systems for subterranean fluid recovery. The system is capable of being integrated with well management automation systems, thereby allowing for response to active control commands, and automatically altering and/or maintaining a counterbalance force in the pumping unit by adding or removing air mass from a containment vessel associated with the pumping unit.

20 Claims, 19 Drawing Sheets

(56) References Cited

U.S. PATENT DOCUMENTS

2007/0286750 A1 12/2007 Beck et al.
2011/0314959 A1* 12/2011 Smith ..... 74/590

OTHER PUBLICATIONS

International Search Report for corresponding International patent application No. PCT/US2012/064242, mailed May 8, 2013.
Written Opinion for corresponding International patent application No. PCT/US2012/064242, mailed May 8, 2013.
DynaPump, Inc. DynaPump Pumping System Operator's Manual, Document # DP-11MAN-003, Rev. B, issued Sep. 18, 2001.
DynaPump, Inc. brochure, "The Dawn of a New Generation", no date.

* cited by examiner

LOW PROFILE ROD PUMPING UNIT WITH PNEUMATIC COUNTERBALANCE FOR THE ACTIVE CONTROL OF THE ROD STRING

CROSS REFERENCE TO RELATED APPLICATIONS

This applications claims priority to U.S. Provisional patent application Ser. No. 61/557,269, filed Nov. 8, 2011, the contents of which are incorporated herein by reference in their entirety.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to mechanical counterbalances, and more specifically are related to pneumatic counterbalances suitable for use in machinery, such as linear rod pumping units.

2. Description of the Related Art

Beam pumping units and their upstream drive components are exposed to a wide range of loading conditions. These vary by well application, the type and proportions of the pumping unit's linkage mechanism, and counterbalance matching. The primary function of the pumping unit is to convert rotating motion from the prime mover (engine or electric motor) into reciprocating motion above the wellhead. This motion is in turn used to drive a reciprocating down-hole pump via connection through a sucker rod string. An example of a conventional pumping unit arrangement is illustrated generally in FIG. 1, and will be discussed in more detail herein.

The "4-bar linkage" comprising the articulating beam, pitman, cranks, and connecting bearings processes the well's polished rod load into one component of the gear box torque (well torque). The other component, counterbalance torque, is adjusted on the pumping unit to yield the lowest net torque on the gearbox. Counterbalance torque can be adjusted in magnitude but typically not in phase (timing) with respect to the well load torque. In crank balanced machines, counterbalance torque will appear sinusoidal as it is effectively a mass being acted on by gravity while rotating about a fixed horizontal axis. The basic computation for pumping unit crankshaft torque is:

$$T_{net}=T_{well}-T_{ebal}$$

Counterbalance may be provided in a number of forms ranging from beam-mounted counterweights, to crank-mounted counterweights, to compressed gas springs mounted between the walking beam and base structure to name only a few. The primary goal in incorporating counterbalance is to offset a portion of the well load approximately equal to the average of the peak and minimum polished rod loads encountered in the pumping cycle. This technique typically minimizes the torque and forces at work on upstream driveline components reducing their load capacity requirements and maximizing energy efficiency.

Well loads at the polished rod are processed by the 4-bar linkage into crankshaft torque at varying ratios depending on the relative angles of the 4-bar linkage members (i.e. stroke position). Simultaneously, the counterbalance torque produced by one of the various methods above interacts with the well load torque negating a large percentage of it. The resulting net torque exposed to the crank shaft is usually only a small fraction of the original well load torque. Note in the diagram at right that well torque (the component of net torque resulting from the polished rod load) is highly variable, both in magnitude and phase angle (timing). In contrast, the counterbalance torque is smooth and sinusoidal. Its phase angle is established as an attribute of the pumping unit design selected for broadest applicability—and is generally not adjustable. Magnitude and phase angle mismatches between well and counterbalance torque curves are the source of "lumpiness" in the net torque transmitted through the gear reducer and up-stream driveline elements. These elements must be selected with sufficient capacity to survive the peak load conditions encountered during the pumping cycle. Given that the actual pumping work performed during the cycle is equivalent to:

$$\text{WORK}=\int T_{net}d\theta$$

it is evident that the "lumpiness" in the net torque curve results in inefficient utilization of the capacity of these driveline elements. Indeed, the net torque curve in the above example dips into negative (regenerative) values in multiple locations during the cycle further reducing the net work performed.

The chief source of variability in the well torque curve is the elastic response of the sucker rod string to dynamic loads transmitted through it from the down-hole pump and the surface pumping unit. The rod string, sometimes miles in length, behaves over long distances similarly to a spring. It elongates when exposed to tensile stress and when the stress is variable, the response is often oscillatory in nature. The system is damped somewhat due to its submergence in a viscous fluid (water and oil) but the motion profile of the driving pumping unit combined with the step function loading of the pump generally leaves little time for the oscillations to decay before the next perturbation is encountered.

The diagram shown in FIG. 3 illustrates generally some of the interactions at work in a typical rod pumping chain. The surface pumping unit imparts continually varying motion on the polished rod. The connecting sucker rod string, modeled as a series of springs, masses, and dampers, responds to accelerations at the speed of sound sending variable stress waves down its length to alter its own motion. It also stretches as it builds the force necessary to move the down-hole pump and fluid. The pump, breaking away from the effects of friction and fluid inertia tends to rebound under the elastic force from the sucker rods initiating an additional oscillatory response within the string. Traveling stress waves from multiple sources interfere with each other along the rod string (some constructively, others destructively) as they traverse its length and reflect load variations back to the surface pumping unit where they can be measured and graphed as part of the surface dynamometer card. The resulting surface dynamometer card, such as the general example in FIG. 4, shows superimposed indications of large scale rod stretching, damped oscillations, friction, as well as inertial effects all in varying amounts depending on the well application and pumping unit geometry.

Problem Addressed: Fixed proportion 4-bar linkage geometries found in typical beam pumping units exhibit application preferences for a relatively narrow band of operating conditions (i.e. conventional units for upward sloping dynamometer cards, Mark II for downward sloping cards, Reverse Mark for level cards, etc). These preferences are fundamental to a particular linkage geometry and are very difficult to change. This is not to say that a Mark II pumping unit (Lufkin Industries, Inc.) cannot operate with an upward sloping card, merely that an optimal efficiency preference exists and that performance consequences are created when they are not obeyed. The diagrams in FIGS. 5 and 6 provide some illustration of this point. Permissible load diagrams (PLD) for similarly sized and counterbalanced Conventional and Mark II (Lufkin Industries, Lufkin, Tex.) pumping units are shown along with a surface dynamometer card for comparison in FIG. 5. Permissible load diagrams display the polished rod load that would be required to create crankshaft torque equivalent to the gear reducer torque rating for a given pumping unit design and counterbalance setting. It can be observed from the shape of the permissible load diagrams in FIG. 5 that the conventional pumping unit exhibits a preference for dynamometer cards with an upward sloping trend (moving from left to right). Conversely, as shown in both FIG. 5 and FIG. 6, the Mark II unit shows a preference for cards that slope downward. The dynamometer card in this instance also shows a slight upward trend causing it to conform somewhat better to the PLD of the conventional unit. Note that both pumping units would be operating at near their up-stream driveline capacities, given the relative proximity of the peak and minimum polished rod load to their respective PLDs.

However, the area of the Mark II unit PLD is substantially larger than that of the Conventional unit indicating that it is capable of performing more work during its pumping cycle. The extra available work capacity of the Mark II pumping unit would be underutilized in this particular application.

An unfortunate reality is that rod pumping dynamometer cards are almost never the vaguely hourglass shape that would maximize the work potential of most beam pumping units, at least not under the near constant rotating velocity conditions under which they have been designed to operate.

Automation technologies for rod pumping applications have existed for a number of years. Operating wells can be monitored by an assortment of methods to collect load and motion information at the surface, then, by computer simulation, diagnose such things as overload conditions or the onset of down-hole issues ranging from pump-off (incomplete pump fillage) to rod buckling to worn or damaged equipment. The predictive simulations performed by many of these rod pump control (RPC) systems are able to accurately model the elastic-dynamic behavior of the rod pumping chain (pump, rods, and pumping unit) with relatively minimal program data entry.

More recently, variable speed drives (VSD) have been integrated with rod pumping unit applications and in conjunction with RPC technology, have markedly improved the longevity and efficiency of many rod pumping systems. Today, it is relatively common to see operating pumping units being monitored by RPCs which can sense system anomalies and send corrective action commands to a VSD to, for example, adjust pumping speed down in response to detected pump-off conditions or possibly to shut down in response to excessive loading. If used in conjunction with supervisory control and data acquisition (SCADA) technology, a well and rod pumping system can be monitored and controlled remotely making it possible to identify and respond to potential equipment maintenance issues or change production goals from a control center miles or perhaps continents away.

The relatively poor pumping unit capacity utilization portrayed in the case above might be at least partially remedied through active speed control. Pumping unit dynamometer cards tend to be fairly repetitive from cycle to cycle and speeding up or slowing down at strategic points within the cycle could influence the shape of the dynamometer card to either truncate load spikes, improve driveline capacity utilization, increase production, or improve system efficiency. Active control of the pumping unit's force/motion profile could also yield significant benefit in terms of rod, tubing, and down-hole pump life. In certain instances, such as with the use of fiberglass sucker rods, RPC and VSD technology could be used jointly with goal seeking algorithms, actively controlling the motion profile to produce large down-hole pump displacements while simultaneously protecting the rod string from the onset of buckling as an example.

Unfortunately, the flywheel effect produced by massive rotating components within the pumping unit resists rapid changes in speed. Cranks, counterweights, gears, sheaves, brake drums and other rotating components in the system contribute to the overall flywheel effect and require significant torque exertion to alter their rotating speed. This presents a substantial impediment to active control scenarios such as those mentioned above. Attempts to substantially alter speed within the pumping cycle with a VSD to date have generally consumed disproportionately more power which negatively affects operating cost. Pumping unit designs with substantially reduced mass moments of inertia appear to be a prerequisite to fully implementing active speed control in rod pumping.

Mass based counterbalance systems present problems in continually maintaining optimum counterbalance as well conditions change. Fluid level in the casing annulus of the well tends to decline with production over time. As fluid level drops, the rod pumping system must lift the fluid from greater depth increasing the amount of counterbalance needed. Conversely, if the well is shut in for an extended period of time, fluid level will typically rise, reducing the needed counterbalance proportionally. Failure to maintain proper counterbalance can lead at best to inefficient power usage and at worst to upstream equipment failures due to overload. Generally, counterbalance adjustments on existing beam unit designs are performed manually by repositioning, adding or removing counterweights in an equipment and labor intensive process requiring unit shut-down and restraint, entry into a hazardous area, use of expensive cranes and equipment, and temporary loss of production to the operator.

Changing stroke length is also a manual process involving the same steps as those above (unit must be re-balanced following a stroke change) with the notable additions that the pumping unit must be decoupled from the well load, crank pins must be driven out and shifted to another hole in the crank arm, crank arms must be re-positioned by crane during re-stroking and the down-hole pump must be re-spaced, also by crane, prior to restoring to service.

Down-hole pump valve testing (valve checks) is generally accomplished by halting the pumping unit's motion on the up-stroke or down-stroke and measuring the rate at which polished rod load declines or rises as a means of assessing leakage rates in the pump's valving. The method of testing typically requires the use of a portable dynamometer and insertion of a calibrated load cell between the carrier bar and rod clamp.

Large and heavy moving parts at near ground level requires relatively extensive safety guarding to prevent inadvertent contact with personnel while the pumping unit is in motion.

The inventions disclosed and taught herein are directed to adaptable surface pumping units that include and combine automation technology with a low inertia pumping unit mechanism capable of responding to active control commands from a well management automation system, thereby allowing the surface pumping unit to change in reaction to changing well conditions, the pumping unit being capable of self-optimization, self-protection, and of safeguarding expensive down-hole equipment, while at the same time presenting a small environmental footprint designed such that typical safety hazards are eliminated or reduced, minimizing the need for warning signage. Such pumping unit systems may further automatically altering and maintaining counterbalance force by controlling the addition or elimination of fluid (e.g., air) mass from a containment vessel associated with the pumping unit.

BRIEF SUMMARY OF THE INVENTION

The objects described above and other advantages and features of the invention are incorporated in the application as set forth herein, and the associated appendices and drawings, related to systems and methods for improved pumping units for use with a hydrocarbon producing well, wherein the pumping unit includes an assembly for automatically altering and maintaining counterbalance forces within the unit during operation so as to actively control rod string motion and/or force, wherein the system exhibits low inertia.

In accordance with select aspects of the disclosure, an adaptable surface pumping unit that combines automation technology with a low-inertia pumping unit mechanism capable of responding to active control commands from well management automation system, thereby adapting to changing well conditions. Such a pumping unit is capable of self-optimization, self-production, and of safeguarding expensive down-hole equipment. Additionally, such a pumping unit has a small environmental footprint in that it is designed in such a way that safety hazards are eliminated or reduced to the point that guarding and warning signage requirements are minimal.

Also described is a device and associated method of operation for automatically altering and maintaining counterbalance force by adding or removing air mass from the containment vessel of the pumping unit. The method for developing target counterbalance air pressure is based on linear regression analysis of measured well load and position data along with the average peak and minimum well loads. Such method also may include a system and method for correcting air counterbalance pressure by recursive error reduction methods by comparing target and measured air pressure values. An alternative, yet equally viable variant on the method for correcting air counterbalance pressure by recursive error correction may include comparing peak magnitude up-stroke and down-stroke motor torque or current values and balancing them.

In accordance with further aspects of the present disclosure, a device and method for automatically altering the compressible volume inside a pneumatic pressure vessel for counterbalancing a pumping unit is described, the method including displacing a portion of the compressible volume with an incompressible substance (or mixture of incompressible substances), thereby changing the shape of the permissible load envelope for the pumping unit. Such incompressible substances suitable for use include non-corrosive liquids and fluids, such incompressible substance being contained in a bladder, diaphragm, or free-standing sump assembly.

In further accordance with this aspect, methods of transferring incompressible liquid between the reservoir and pressure vessel are described, the methods include using a pump and/or electrically actuated valve automatically in response to commands issued by a rod pump controller (RPC).

In further aspects of the present disclosure, a device and method for automatically altering the compressible volume inside a pneumatic pressure vessel for counterbalancing a pumping unit are described, the methods including displacing a portion of the compressible volume with a movable piston, thereby changing the shape of the permissible load envelope for the pumping unit.

In yet another aspect of the present disclosure, a system and method for actively controlling the motion of a rod pumping unit to improve fluid production volume by incrementally increasing work performed within the pumping cycle, wherein the method includes analyzing well dynamometer data, comparing the dynamometer data to one or more pumping unit permissible load envelopes, and varying pumping speed of the rod pumping unit through regions of the dynamometer to reduce load and torque where needed, and/or expand the vertical load range in the dynamometer card through under-utilized sections of the permissible loading envelope to maximize cycle work (production), thereby protecting the rod string from the onset of conditions such as buckling or excessive stress levels.

In accordance with a first embodiment of the present disclosure, surface pumping units for obtaining fluids from a subterranean formation are described, as well as methods for their use, the units including a pneumatic pressure vessel in operative communication with the pumping unit, the pressure vessel capable of automatically altering the compressible volume inside the pressure vessel for counterbalancing the pumping unit by displacing a portion of the compressible volume with an incompressible substance.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
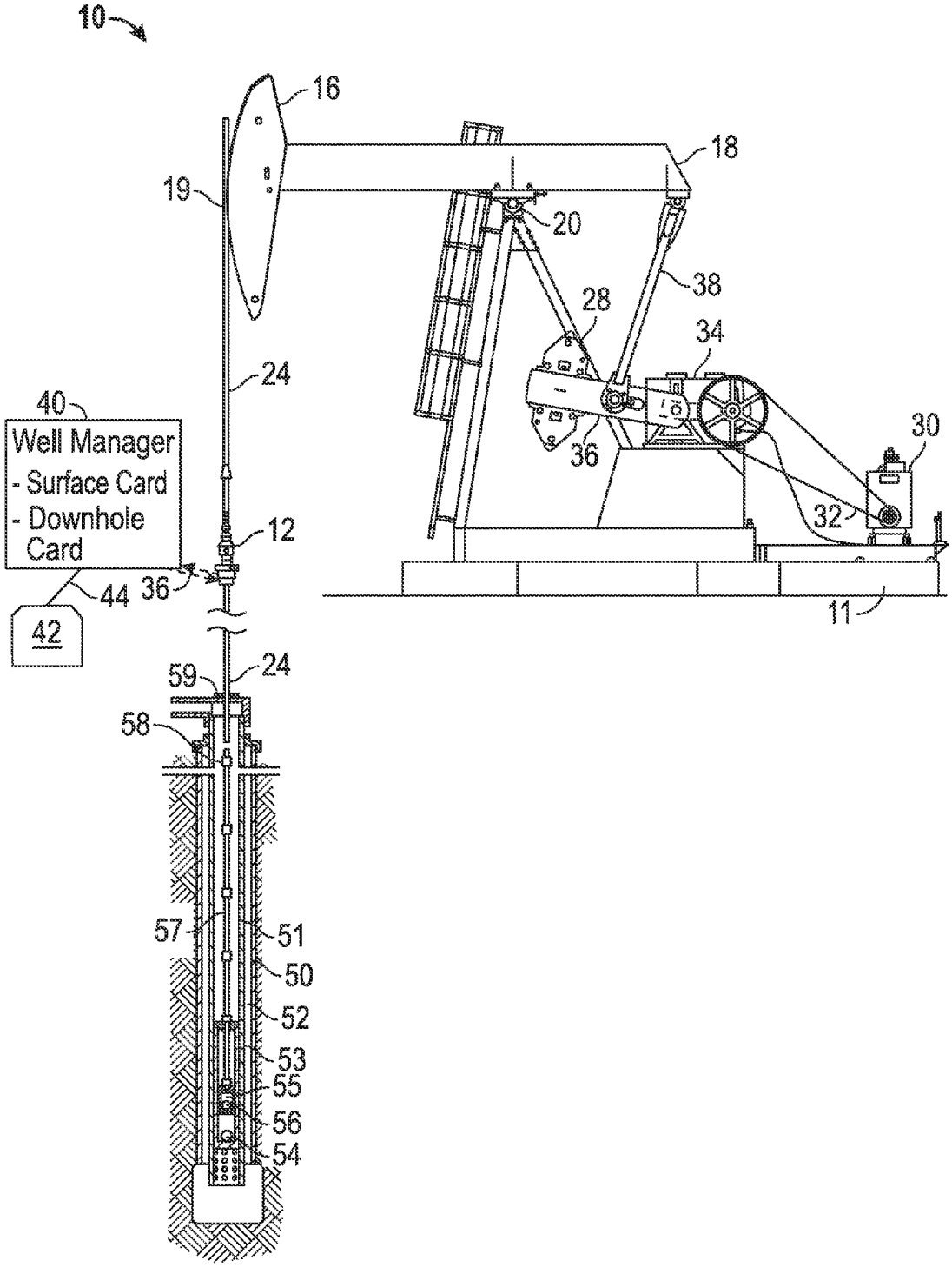
FIG. 1 illustrates a diagrammatical side elevational view of an exemplary pumpjack unit.
Figure 2A:
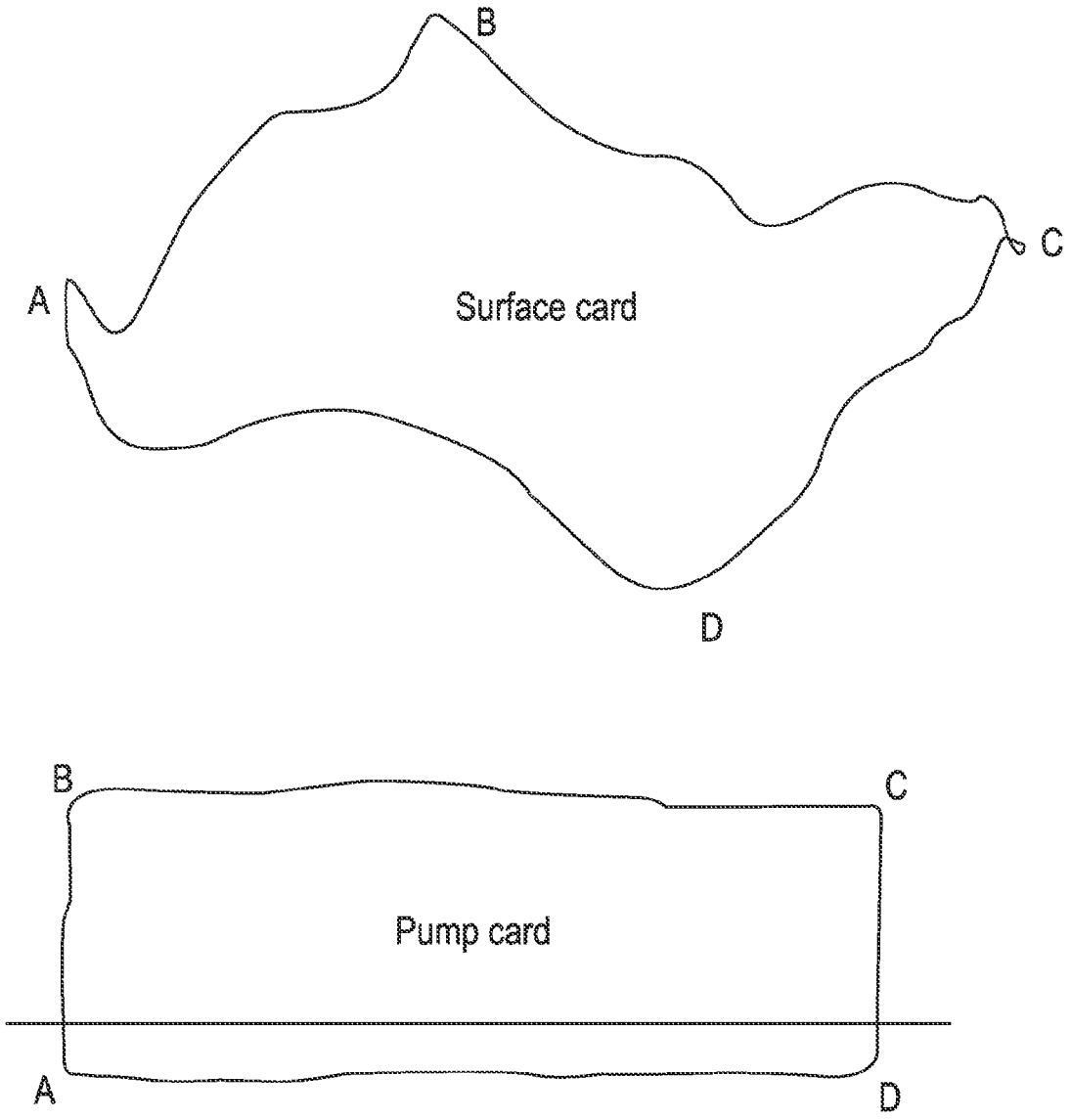
FIG. 2A illustrates general schematic pump cards down hole and at the surface.
Figure 2B:
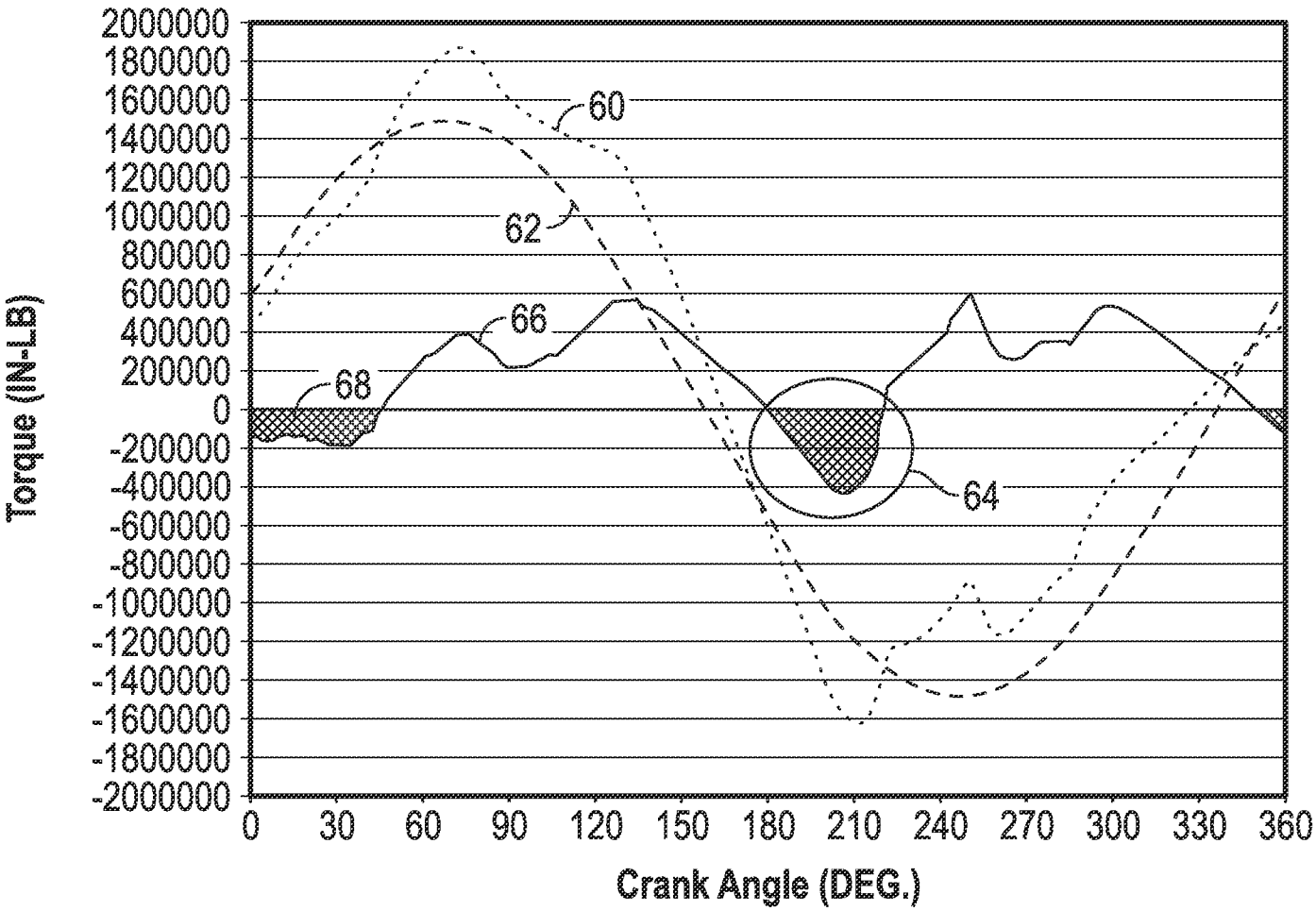
FIG. 2B illustrates a schematic illustration of well load torque versus crank angle.
Figure 3:
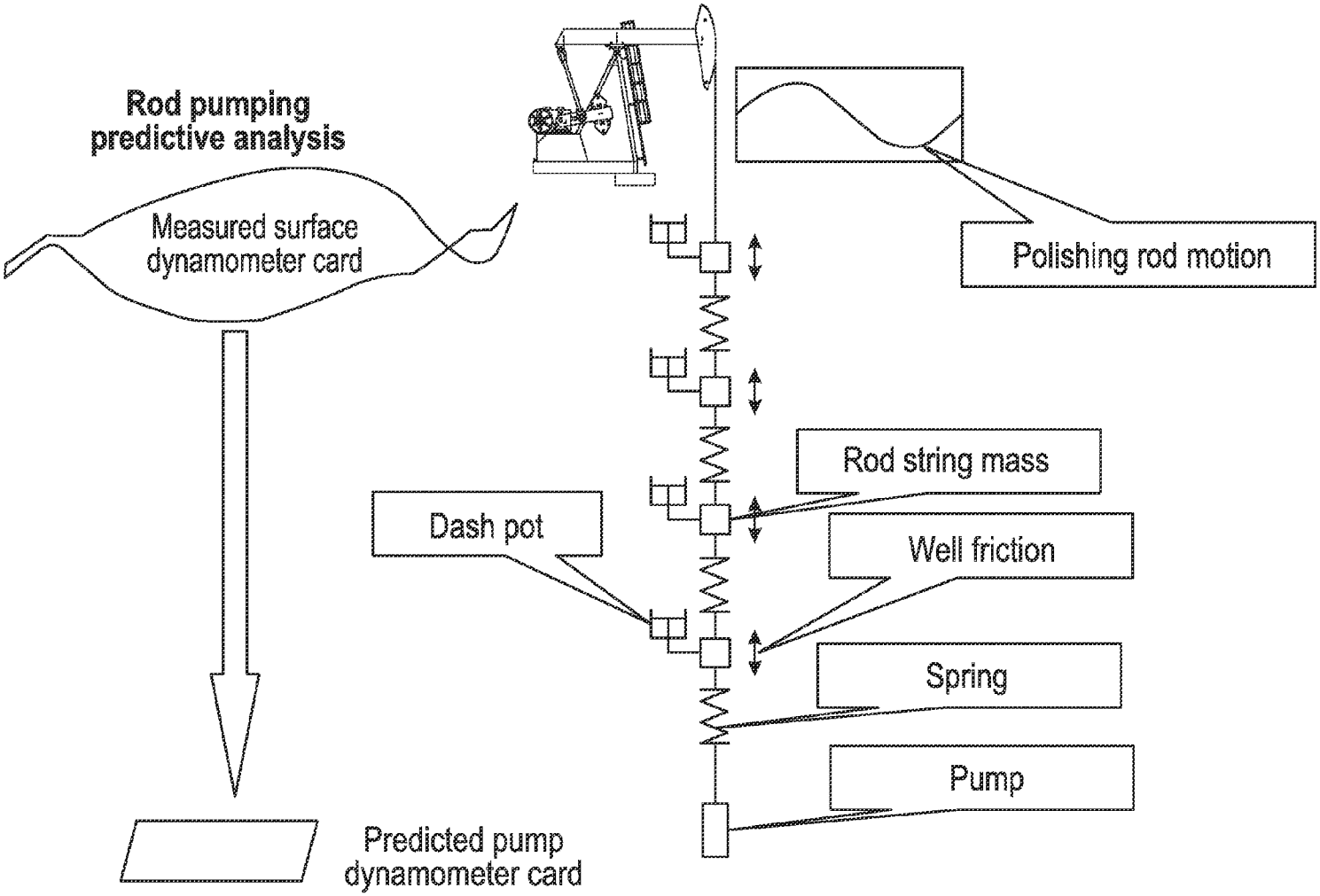
FIG. 3 illustrates a general schematic of the rod pumping predictive analysis process.
Figure 4:
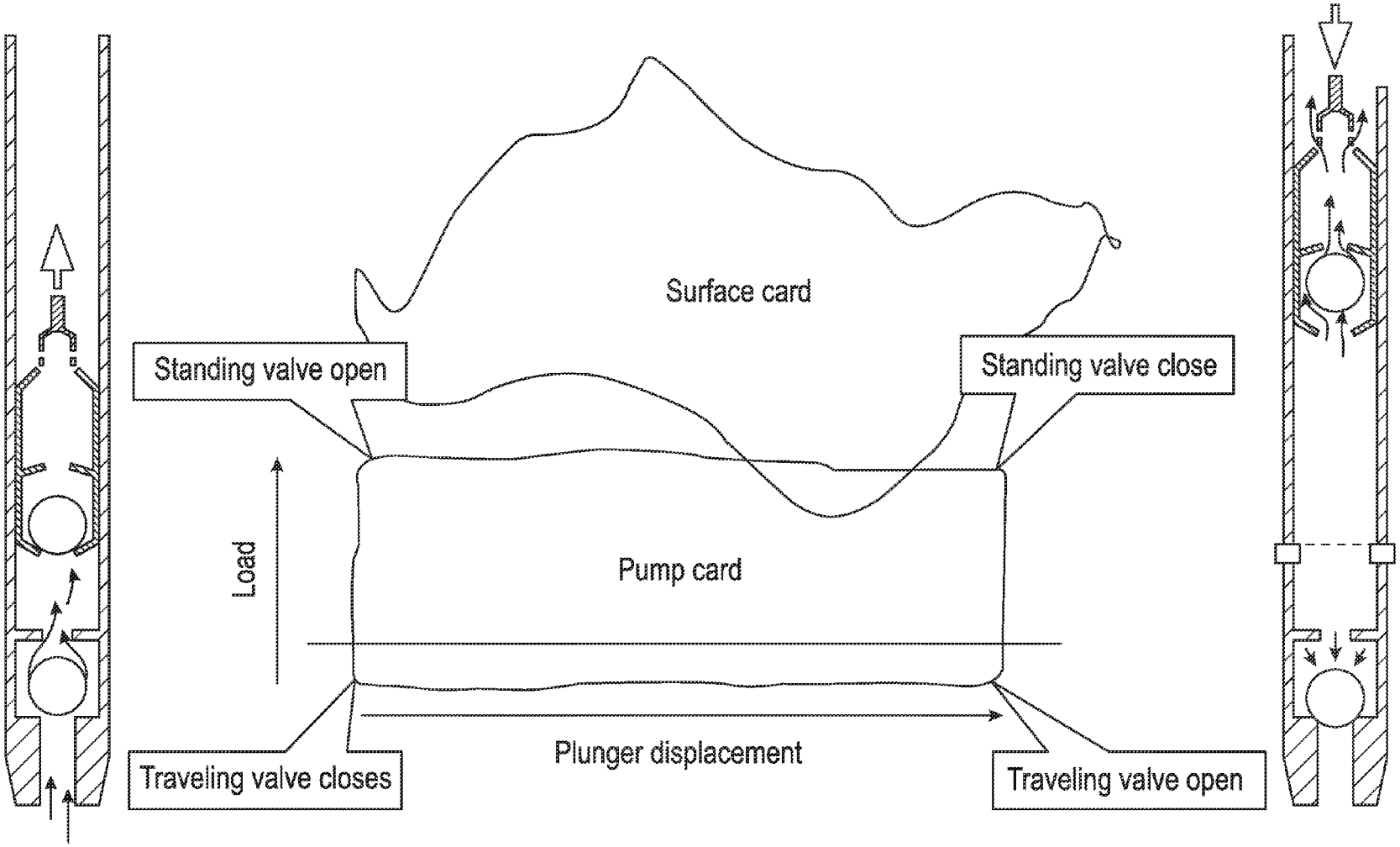
FIG. 4 illustrates schematic pump cards for different positions in the pumping cycle, and showing the operation of valving in a typical pumping system.
Figure 5:
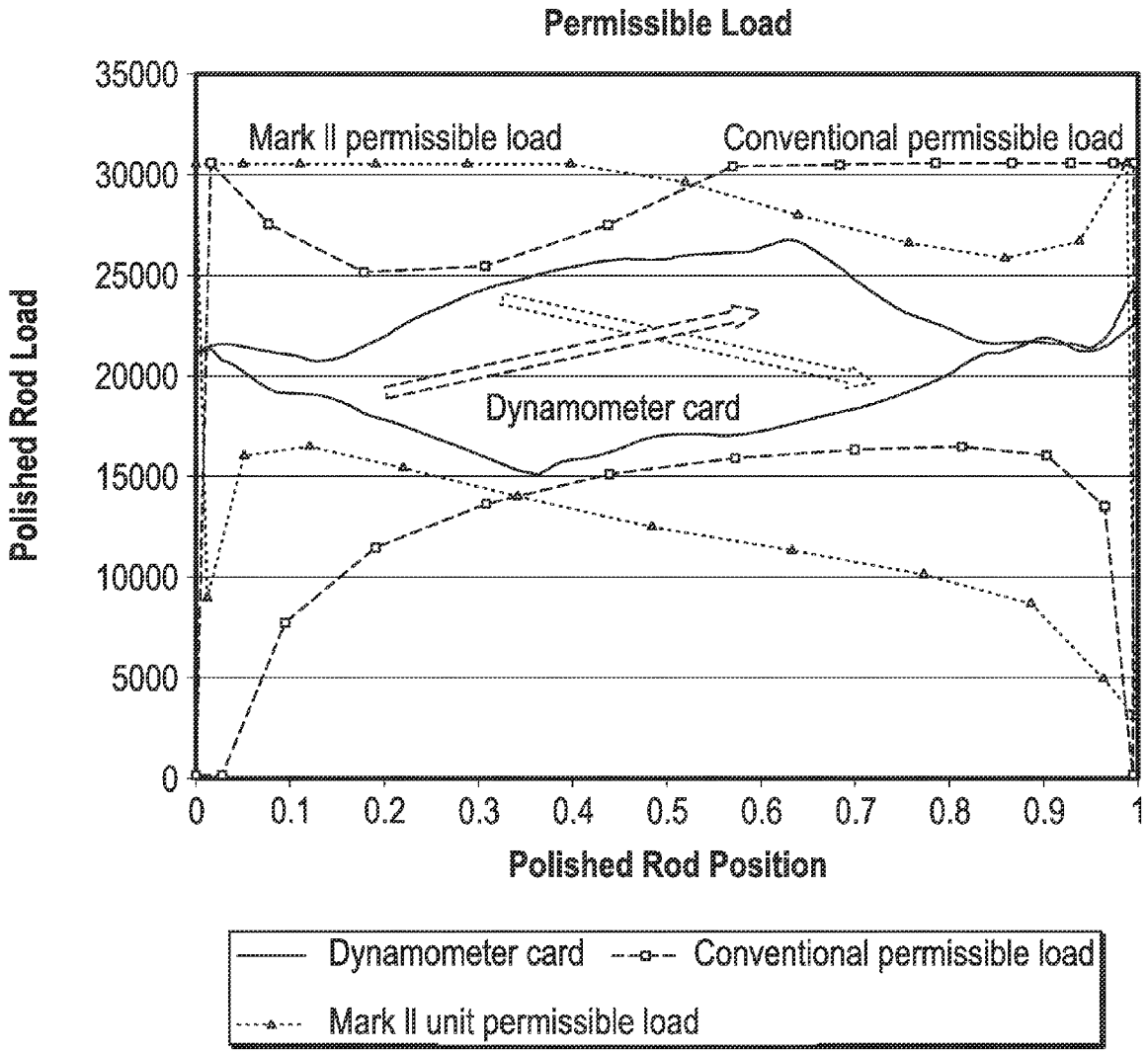
FIG. 5 illustrates a general schematic of permissible loads and an associated dynamometer card for conventional and a Mark II pumping unit.
Figure 6:
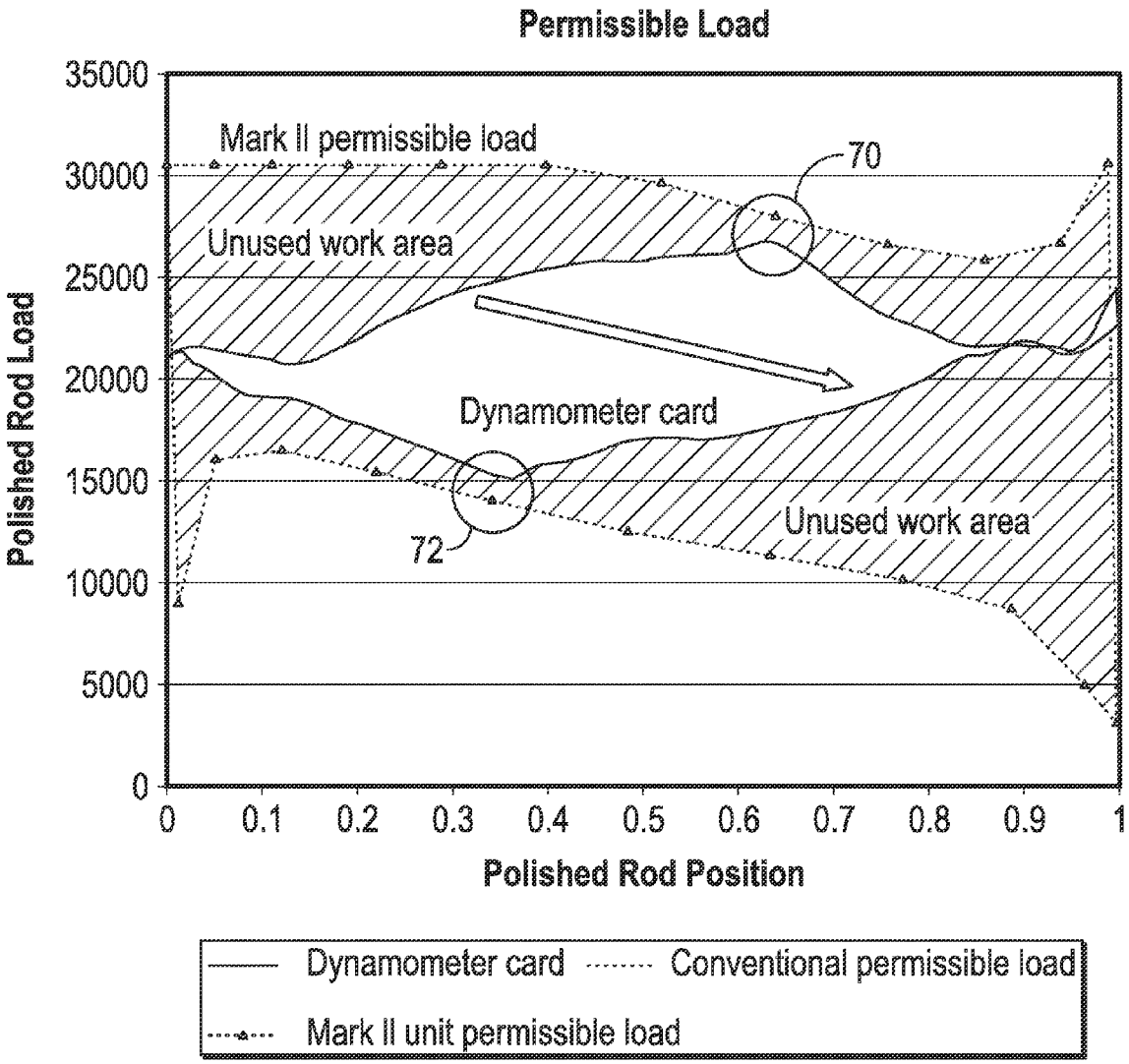
FIG. 6 illustrates an alternative presentation of the data of FIG. 5, highlighting the unused work areas for the two pumping units.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Particular embodiments of the invention may be described below with reference to block diagrams and/or operational illustrations of methods. It will be understood that each block of the block diagrams and/or operational illustrations, and combinations of blocks in the block diagrams and/or operational illustrations, can be implemented by analog and/or digital hardware, and/or computer program instructions. Such computer program instructions may be provided to a processor of a general-purpose computer, special purpose computer, ASIC, and/or other programmable data processing system. The executed instructions may create structures and functions for implementing the actions specified in the block diagrams and/or operational illustrations. In some alternate implementations, the functions/actions/structures noted in the figures may occur out of the order noted in the block diagrams and/or operational illustrations. For example, two operations shown as occurring in succession, in fact, may be executed substantially concurrently or the operations may be executed in the reverse order, depending upon the functionality/acts/structure involved.

Applicants have created pumping unit systems and methods of use thereof which exhibit a low inertia upon use, are capable of interfacing with and responding to active controls and commands form a well management automation system so as to adapt to changing well conditions during unit operation. Such pumping unit systems include one or more fluid pressure vessels in fluid pressure communication with each other and the pumping unit, to allow for the automatic altering and maintaining of counterbalance forces of the pumping unit, such as by adding or removing fluid mass from one or more pressure vessels.

So that the structure, operation, and advantages of the pumping unit systems of the present invention can be best understood, a typical pumping unit system 10 is shown in FIG. 1. According to the depicted embodiment, system 10 is an oil well recovery pump for recovering fluid from beneath the earth's surface 9. The pumping unit is indicated generally at 10, and includes a base 11 that is placed on a foundation adjacent the bore hole of a well. A plurality of integrated support posts 14, each of which is known in the art as a Samson post, is mounted on base 11 and extends upwardly to a center bearing or pivot connection 20. A walking beam 18 is mounted on center bearing 20 so that the center bearing is the pivot point for oscillation of the beam. A horse head 16 is attached to a forward end of walking beam 18, and a wireline 22 is attached to and extends between the horse head and a carrier bar 15. Carrier bar 15 in turn is attached to a rod string 26, which extends into the well through wellhead 12 (alternatively referred to as a stuffing box, tee, etc.). As described above, wireline 22 follows the curve of horse head 20 as the forward end of walking beam 18 raises and lowers, which enables pumping unit 10 to provide a vertical stroke of rod string 26. System 10 comprises horse head 16 positioned at one end of walking beam 18, which is actuated between a first position, e.g., top dead center (TDC), and a second position, e.g., bottom dead center (BDC) as part of system 10's operation to recover fluid from a subterranean formation. To that end, as walking beam 18 is actuated between its top and bottom position, horse head 16 undergoes an up and down motion. Accordingly, bridle line cable 19, extending between horse head 16 and polished rod 24, causes polished rod 24 to reciprocate within well head 12. This action ultimately causes fluid to be pumped to the surface.

As described above, a prime mover or drive unit 22 drives the oscillation of walking beam 18 about center bearing or pivot connection 20. Drive unit 30 typically is an electric motor or an internal combustion engine, and is shown herein as an electric motor for the purpose of convenience. Motor 30 is connected by belts (such as V-belt 32) and sheaves (not shown) to a gear reducer 34. Gear reducer 34 is located between and is pivotally connected to one or more crank arms 36, and each one of the crank arms is in turn pivotally connected to a respective one of a pair of Pitman arms 38. Each Pitman arm 38, in turn, is connected to an equalizer bar (not shown) that extends between the Pitman arms.

This connection of motor 30 to gear reducer 34, to crank arms 36, to Pitman arms 38 and to walking beam 18 enables the walking beam to be driven in an oscillating manner about center bearing 20. The use of two crank arms 36 and two Pitman arms 38 is known as a four-bar lever system, which converts rotational motion from motor 30 to reciprocating motion at horse head 16. When motor 30 is turned off and it is desired to stop the motion of walking beam 18, a brake lever is actuated by an operator, as known in the art.

The system 10 in FIG. 1 is preferably equipped with a controller 40 coupled to variable frequency drive (VFD) 42 via a communication path 44. The controller 40, sometimes referred to equivalently as an on-site well manager, preferably includes a microprocessor and controller software. The VFD 42 also includes a microprocessor and has its own VFD software. The VFD 42 controls the speed of the prime mover 30 as a function of control signals from controller 40. The rotational power output from the prime mover 30 is transmitted by a belt 32 to a gear box unit. The gear box unit 34 reduces the rotational speed generated by prime mover 30 and imparts rotary motion to a crank shaft end, a crank arm 36, and to a pumping unit counterbalance weight 28. The rotary motion of crank arm 36 is converted to reciprocating motion by means of the walking beam 18.

FIG. 1 further shows a nominally vertical well having the usual well casing 50 extending from the surface 9 to the bottom thereof. Positioned within the well casing 50 is a production tubing 51 having a pump 52 located at the lower end. The pump barrel 53 contains a standing valve 54 and a plunger or piston 55 which in turn contains a traveling valve 56. The plunger 55 is actuated by a jointed sucker rod 57 that extends from the piston 55 up through the production tubing to the surface and is connected at its upper end by a coupling 58 to a polished rod 24 which extends through a packing joint 59 in the wellhead.

The embodiment depicted at FIG. 1 provides several advantages over other systems known in the art. These advantages are provided by a number of subsystems that, standing alone and working in combination with one another, allow system 10 to provide, among other things, low operating torque, high operating efficiency, low inertia, controlled rod string motion and/or force, and less required working energy. These subsystems, as will now be described in greater detail, will generally be referred to as a Counterbalance Subsystem.

Counterbalance Subsystem.

According to the preferred embodiment depicted at FIG. 1, a combination of counterbalancing methods are used to provide what is sometimes referred to herein as a counterbalance effect (CBE), which serves to reduce, or effectively counterbalance, the well torque exerted upon the system. As known by those skilled in the art, well torque generally refers to the torque placed upon the system resulting from the force of recovered fluid and the working components lifted by the system during recovery. This counterbalancing effect maximizes energy efficiency. Referring again to FIG. 1, counterbalance weights 28 are positioned at the end of the pitman arm 38 on the opposite side of the center bearing/pivot connection 20 from horse head 16. During operation of system 10, the torque exerted upon beam 18 at Sampson bearing center 20 by the counterweight serves to counterbalance the torque exerted upon beam 18 at bearing center 20 by the recovered fluid in combination with working components extending from horse head 16 (e.g., polished rod 14 and bridle line cable 19). This torque may be thought of as "opposing torque." According to embodiments of the present disclosure, the torque exerted by the counterweight 28 is changed in response to the opposing torque exerted upon beam 18. For example, it is typically desirable for the CBE to be increased as the opposing torque increases, e.g., during the upstroke, and to be decreased as the opposing torque decrease, e.g., during the downstroke.

Figure 7:
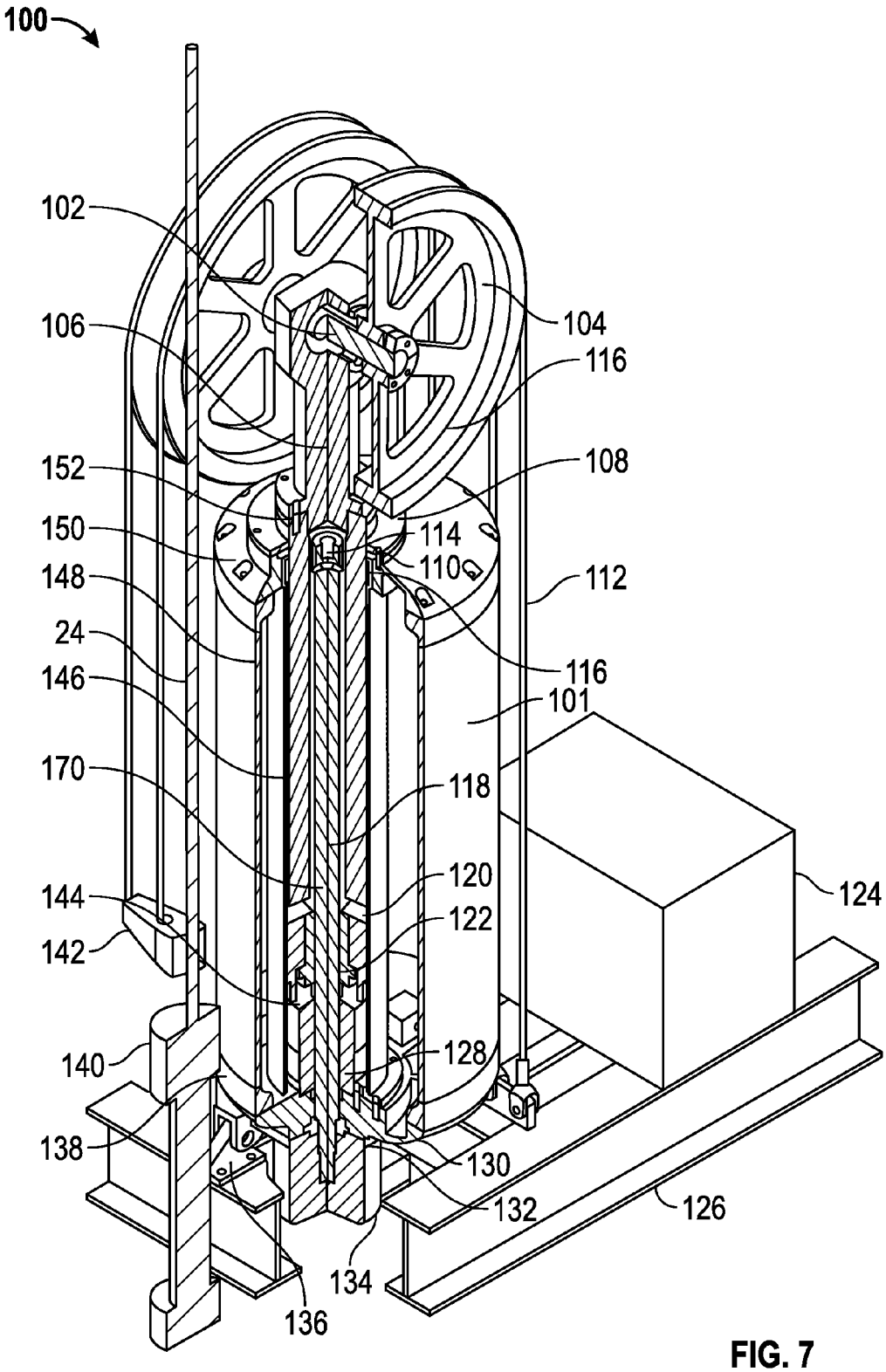
FIG. 7 illustrates a perspective, partial cut-away view of an exemplary system in accordance with aspects of the present disclosure.
Figure 8:
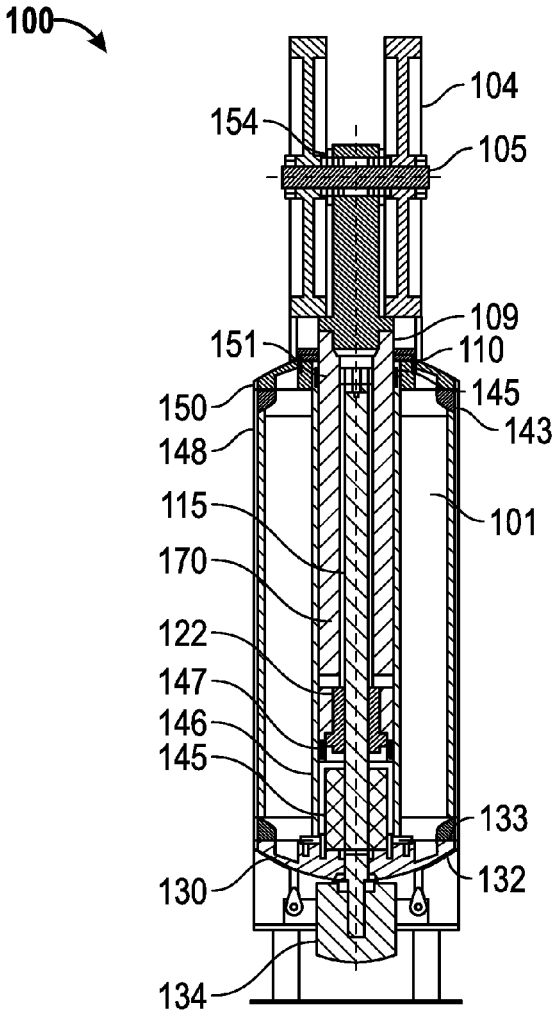
FIG. 8 illustrates a front cross-sectional view of the assembly of FIG. 7.
Figure 9:
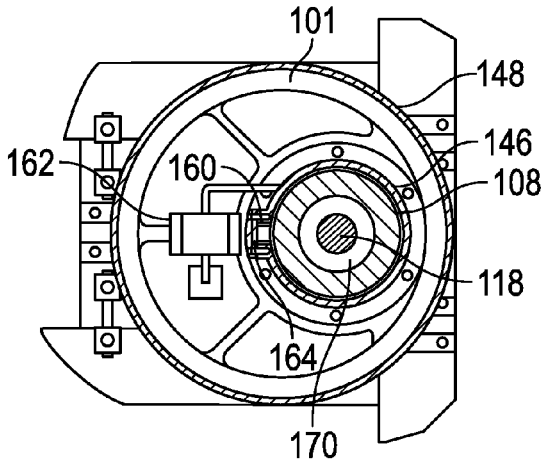
FIG. 9 illustrates a top-down cross-sectional view of the assembly of FIG. 7.

Current Invention:

In one embodiment of the present disclosure, the current invention comprises a vertically oriented rod pumping unit having a linear motion vector 100 situated adjacent to the well head for the purpose of reciprocating a down-hole pump via connection through a sucker rod string. One purpose of the invention is to facilitate the lifting of liquids from a subterranean well. In this embodiment, and with reference to FIGS. 7, 8 and 9, the current invention comprises a pressure vessel 101 statically connected to a mounting base structure 126. This base structure may be anchored to a stable foundation situated adjacent to fluid producing subterranean well. The pressure vessel 101 may be composed of a cylindrical or other appropriately shaped shell body 148 constructed of formed plate and cast or machined end flanges. Attached to the end flanges are upper and lower pressure heads 150 and 130, respectively. Static seals 132 are incorporated into the head/flange joint for containment of interior air pressure within the vessel 101.

Penetrating the upper and lower pressure vessel heads is a linear actuator assembly 170. This actuator assembly is comprised of a vertically oriented threaded screw 118, a planetary roller nut 122, a forcer ram 108 in a forcer ram tube 109, a thrust bearing assembly 141, a screw centralizer bearing 151, a guide tube 146, ram guide bearings, an anti-rotation mechanism 160, a brake assembly, a motor 134, and seals 132 and O-rings (133, 143) for pressure fluid containment within the pressure vessel.

Figure 12:
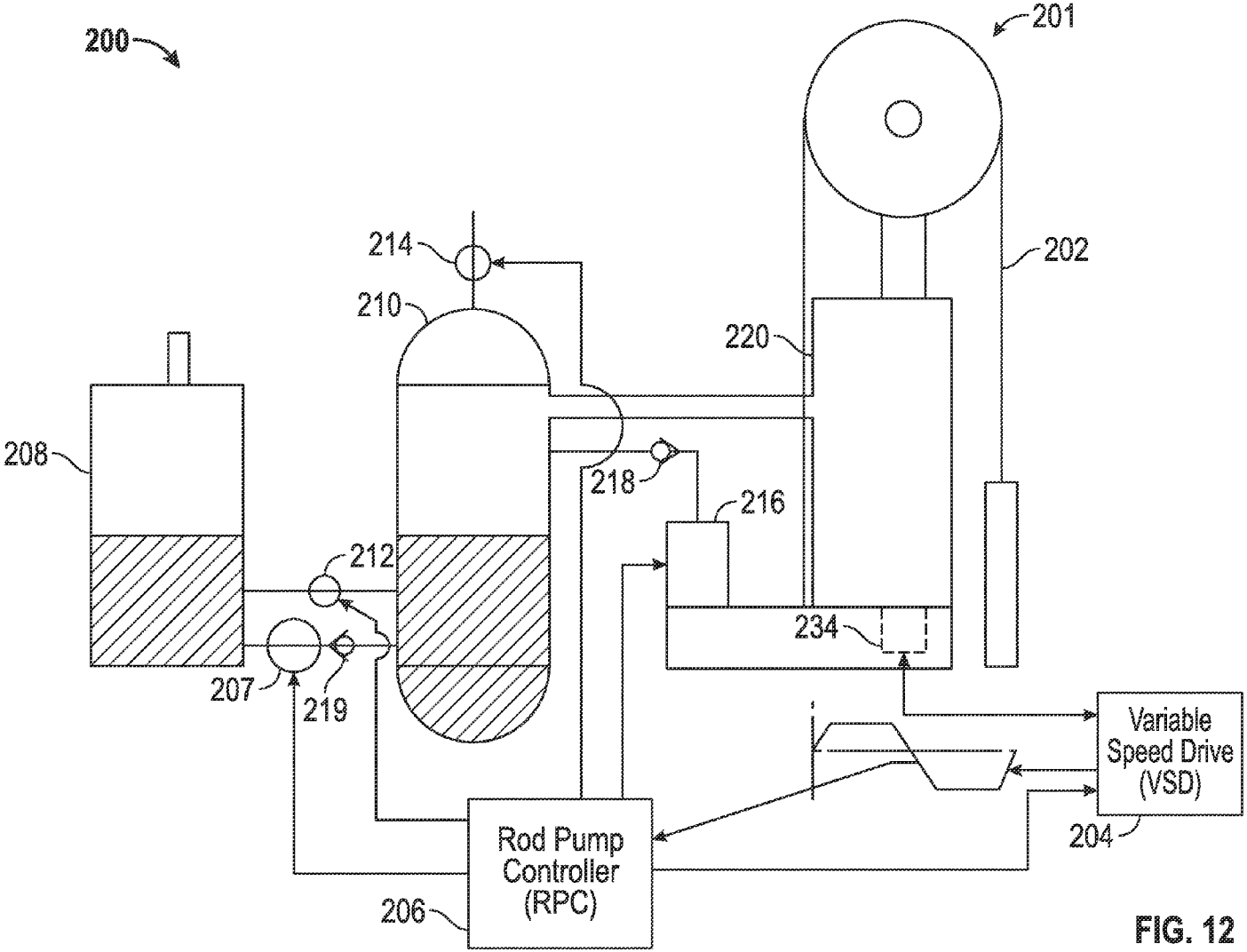
FIG. 12 illustrates a schematic view of a pressure-actuating assembly in accordance with the present disclosure.

The roller screw 118 is supported on a thrust bearing assembly mounted to the interior surface of the lower pressure vessel head 130. The lower portion of the screw is machined to interface with the thrust bearing 145 and rotary seal 132 as it passes through the lower pressure vessel head 130. The shaft extension of the roller screw continues below the pressure vessel head interfacing with the brake mechanism and then on to connect with the compression coupling of the motor 134. The torque reaction for the motor 134 is provided through a flange mounting connection between the motor's housing and the lower pressure vessel head 130. The motor is connected to a variable speed drive (VSD) 204 configured such that its rotating speed can be adjusted continuously. With reference to FIG. 12, the VSD 204 can also reverse the motor's direction of rotation so that its range of torque and speed can be effectively doubled. The screw can therefore be operated in the clockwise direction for the upstroke and the counterclockwise direction for the downstroke.

Within the pressure vessel, the threaded portion of the screw is interfaced with a planetary roller screw nut assembly 122. The nut assembly 122 is fixedly attached to the lower segment of the forcer ram 108 such that as the screw rotates in the clockwise direction, the forcer ram moves upward. Upon counterclockwise rotation, the forcer ram 108 moves downward. This is shown generally in FIGS. 10A and 10B. The forcer ram 108 is supported radially during its axial movement by guide bearings 147 (e.g., rider bands) situated in the annular area between the forcer ram 108 and the guide tube 146. The guide tube 146 is situated coaxially surrounding the forcer tube 109 and statically mounted to the lower pressure head. It extends upward through the shell to slide into a receiver counter bore feature in the upper pressure vessel head 150. Radial support is provided to the upper guide tube through a spacer ring between the guide tube and upper pressure vessel head counter bore walls.

An anti rotation mechanism 160 is necessary to prevent the forcer ram 108 from rotating in conjunction with torque provided by the screw 118. The current embodiment calls for an anti-rotation dog component 160' fixedly attached to a side 111 of the forcer ram 108 and situated such that it slides inside a machined slot in the side wall of the guide tube 146. The interface between the anti-rotation dog 160' and the guide tube 146 provides a rotary constraint for the ram 108 while still allowing it free translation in the vertical axial direction.

Lubrication is provided to moving parts within the mechanism via an electric oil pump 162 situated on the upper surface of the lower pressure vessel head 130. The lower pressure vessel head 130 also serves as the oil sump area where a filtered pump inlet is submerged allowing clean oil to be re-circulated through the pump and distribution system. The ram, screw, nut, and anti-rotation mechanism are all preferably lubricated from a point at the top of the anti-rotation slot in the guide tube.

Fixedly attached and sealed to the upper end of the forcer ram is an upper ram and wireline drum assembly. The two wireline drums are affixed to the ends of an axle that passes laterally through a bore in the top section of the upper ram. The axle is supported on radial bearings sealed in the interior of the upper ram bore. A wireline passes over the drums resting in grooves machined into their outside diameter. The wireline is fixed to anchors on the mounting base at the rear of the pressure vessel. At the forward side of the pressure vessel, the wireline is attached to a carrier bar which is in turn coupled to the polished rod extending from the well head.

Working Principle of the Invention

The working principle of the invention is based on linear force and motion transmission through a planetary roller screw mechanism. A motor may be coupled to the rotating element of a planetary roller screw mechanism. By rotation in either the clockwise or counterclockwise direction, the motor can effect translatory movement of the planetary roller nut (and by connection, the forcer ram) along the length of the screw member. The linear screw mechanism is augmented by air spring counterbalance that is integrated within the mechanism of the roller screw actuator. Air passages are strategically placed within the guide tube, forcer ram, and screw members such that the pressurized air is able to continuously migrate throughout the system and effect force imbalance on the projected area of the forcer ram. The effect is that a relatively consistent lifting force is exerted on the ram to offset the average well load encountered by the pumping unit in addition to the weight of any over head components supported by the moving ram such as wireline, carrier bar, drums, shaft, bearings, and the ram assembly itself. The magnitude of the lifting force is a function of the pressure within the surrounding pressure vessel which varies primarily in accordance with the amount of compressible air volume contained by it.

The amount of counterbalance force may be adjusted and controlled by adding or removing air mass from the containment vessel through activation of a make-up air compressor or electrically actuated bleed valve respectively. Such counterbalance adjustments can be made automatically upon command from a rod pump controller. By monitoring motor torque (inferred from motor current, for example), the peak magnitude up-stroke and down-stroke motor torque values can be compared and balanced by a recursive error reduction computer algorithm using these methods.

Figure 10B:
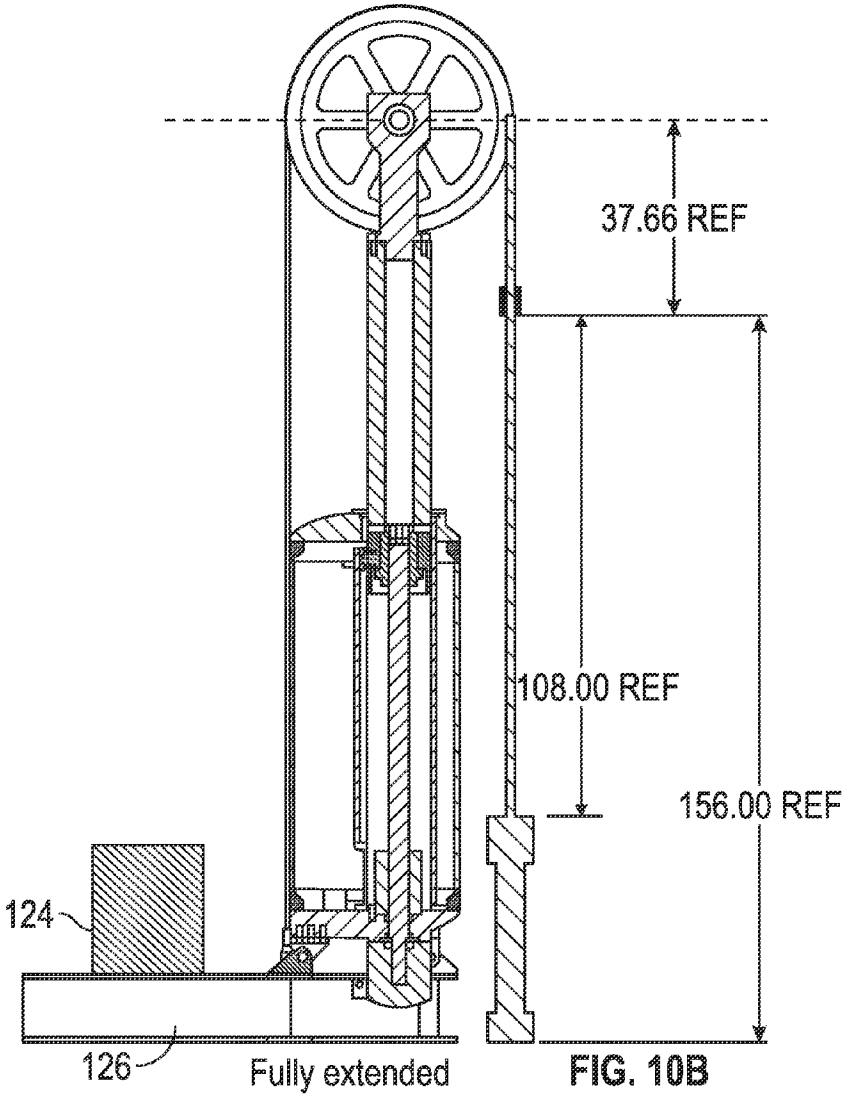
FIGS. 10A and 10B illustrate the exemplary system of FIG. 7 in the fully retracted (10A) and fully extended (10B) positions.
Figure 10A:
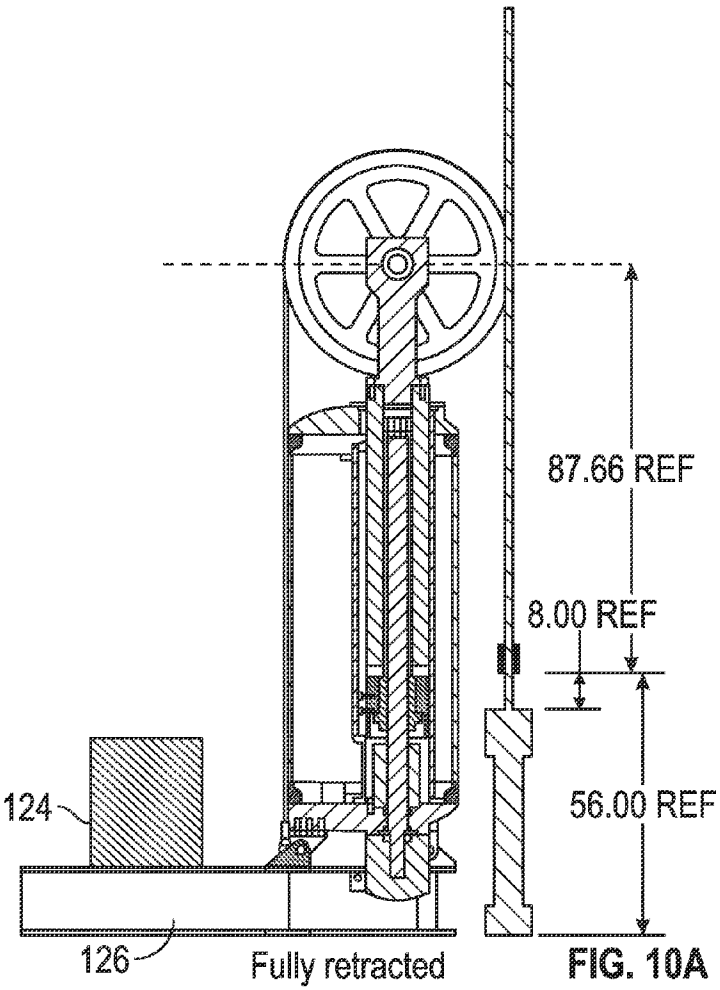

One embodiment of the current invention is indicated in FIG. 10A and FIG. 10B. This embodiment is derived to produce a 100-inch polished rod stroke. In this embodiment, the wireline assembly is anchored to a fixed location of the pumping unit structure at the rear of the pressure vessel. By passing the wireline over the drums mounted at the top of the forcer ram in route to its attachment to the carrier bar above the well head, a 100 inch stroke of the polished rod can be affected with only 50 inches of forcer ram movement. This provides a desirable attribute in compactness of design and relatively slow speed operation of the linear actuation device. This proves advantageous in reducing velocity related wear in components such as seals, guides, etc. Consequently, the forces that must be transmitted by the forcer ram are approximately double those at the well-head.

The permissible load diagram for the linear pumping unit invention is defined as:

$$WL_{perm}(t) = \frac{F_{SCREW}(t) - \frac{W_{assy} + 2CBE(t) + F_{SCREW}(t)}{g} \cdot a(t)}{2} + CBE(t)$$

Figure 11:
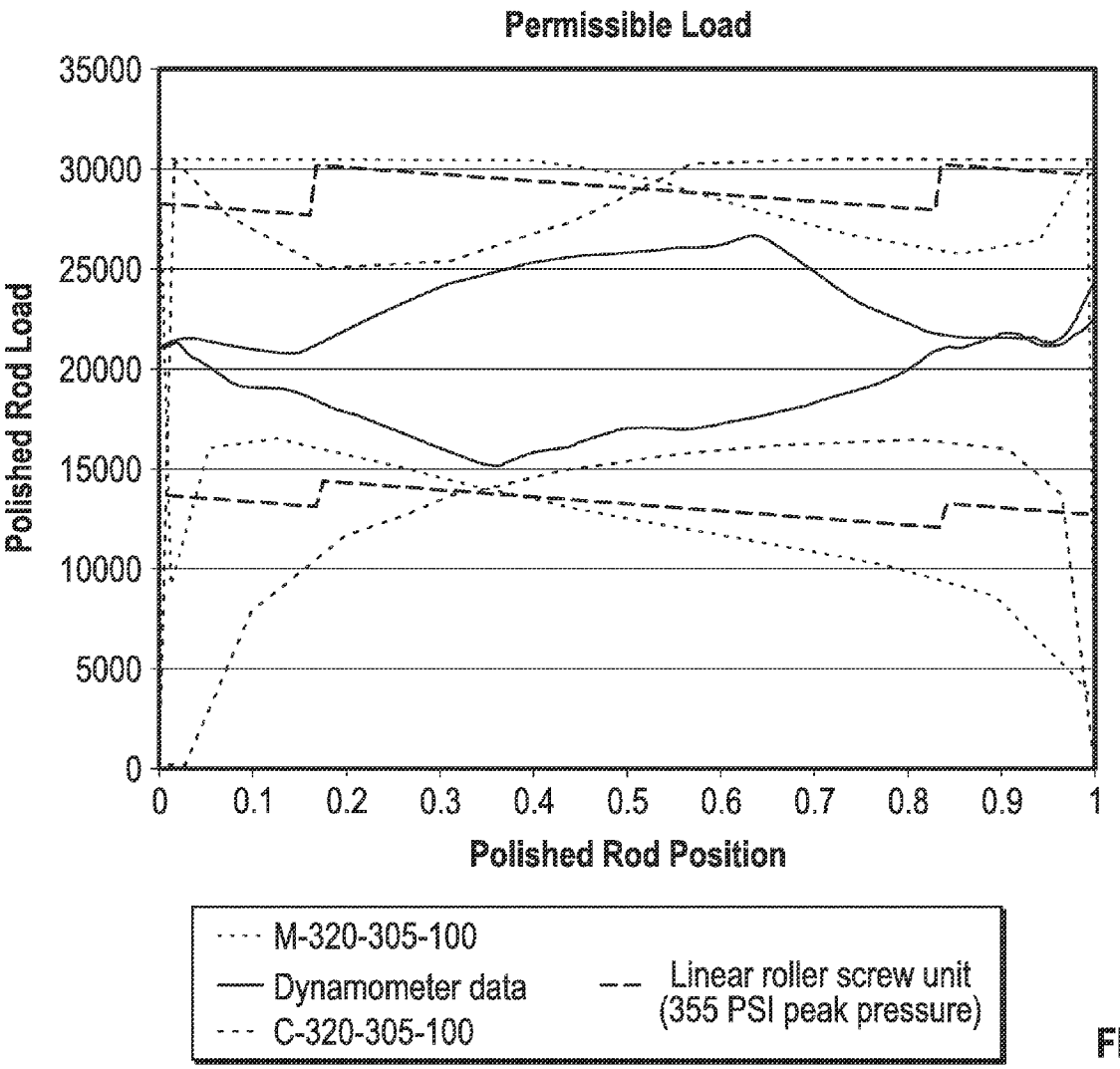
FIG. 11 illustrates an exemplary permissible load diagram and dynagraph of a system in accordance with the present disclosure.

Note that the permissible loading equation above includes inertial terms which are not typically reported for mass balanced beam pumping units although their effects are surely present in those machines as well. The mass of the rod, pump, and fluid loads are characterized as being equivalent to $$\frac{2CBE(t) + F_{SCREW}(t)}{2g}$$

and represent the bulk of the inertial resistance to acceleration in this system. By contrast, the third inertial term, $$\frac{W_{assy}}{2g},$$

represents the internal inertia of the pumping unit invention and is very small in comparison. Neglected in this equation are rotating inertia terms related primarily to the screw and rotating elements of the motor, although they may be included if the circumstances and dynamics of the situation would benefit from such inclusion. Again, these terms are relatively small due to the small diameter (and thus low mass moment of inertia) of the screw. The general trend of the permissible load diagram for the pumping unit invention slopes somewhat downward moving from left to right owing to the inherent variation in counterbalance effect (changes in compressible volume) witnessed as the ram extends and retracts. The downward sloping habit will tend to cause the current invention to show a slight preference for well applications exhibiting down-hole pump plunger "over-travel" characteristics. This is illustrated generally in FIG. 11.

Permissible Load Diagram Conformity

Given that the counterbalance effect (CBE) of the pumping unit is related to the air pressure acting on the ram and that the pressure will vary according to the compressible air volume captured within the containment vessel, an enhancement to the performance envelope of the current invention that is not generally available to other rod pumping unit designs comes to light. That is, a device and method to alter the slope of the pumping unit's permissible load envelope to improve conformity to measured dynamometer load data. Such an exemplary device, in accordance with the present disclosure, is illustrated generally in FIG. 12.

As can be seen from the pumping assembly 200 of FIG. 12, the pumping unit 201 of invention described previously is augmented by an auxiliary pressure vessel 210 arranged so as to be in direct pressure and airflow communication with the primary pressure vessel 220 of the pumping unit. An incompressible fluid (such as a liquid like oil or a similar oleaginous fluid, gas, or mixture of liquids or gases) occupies a portion of the internal volume of the auxiliary pressure vessel 210 being supplied from a storage reservoir 208 at ambient conditions via a pump 207. Fluid may be transferred back and forth between the auxiliary pressure vessel 210 and the reservoir 208 by the aforementioned pump or by an electrically actuated valve 212, each controlled by the rod pump controller (RPC). The purpose of the liquid is to displace a portion of the internal volume within the pressure vessel system 220, thereby making compressible volume a variable that can be controlled through automation. The addition of more liquid into the pressure vessel 220 decreases the compressible volume contained within the system and vice versa. The pressure inside the vessel system varies according to the relation as a polytropic process involving an ideal gas where:

$$P = P_0 \times \left(\frac{V_0}{V}\right)^k$$

P=the pressure inside the vessel at a point of interest;

$P_0$=the pressure inside the vessel at a known condition such as at the bottom of the stroke;

$V_0$=the compressible volume inside the vessel at a known condition such as at the bottom of the stroke;

V=the compressible volume inside the vessel at a point of interest; and, k=the specific heat ratio of the gas in question (approximately 1.4 in the case of air; otherwise, generally a predetermined value).

As will be understood, gases, particularly natural gas, does not always have the same molecular composition, and thus the specific heat ratio k, can vary.

Figure 13:
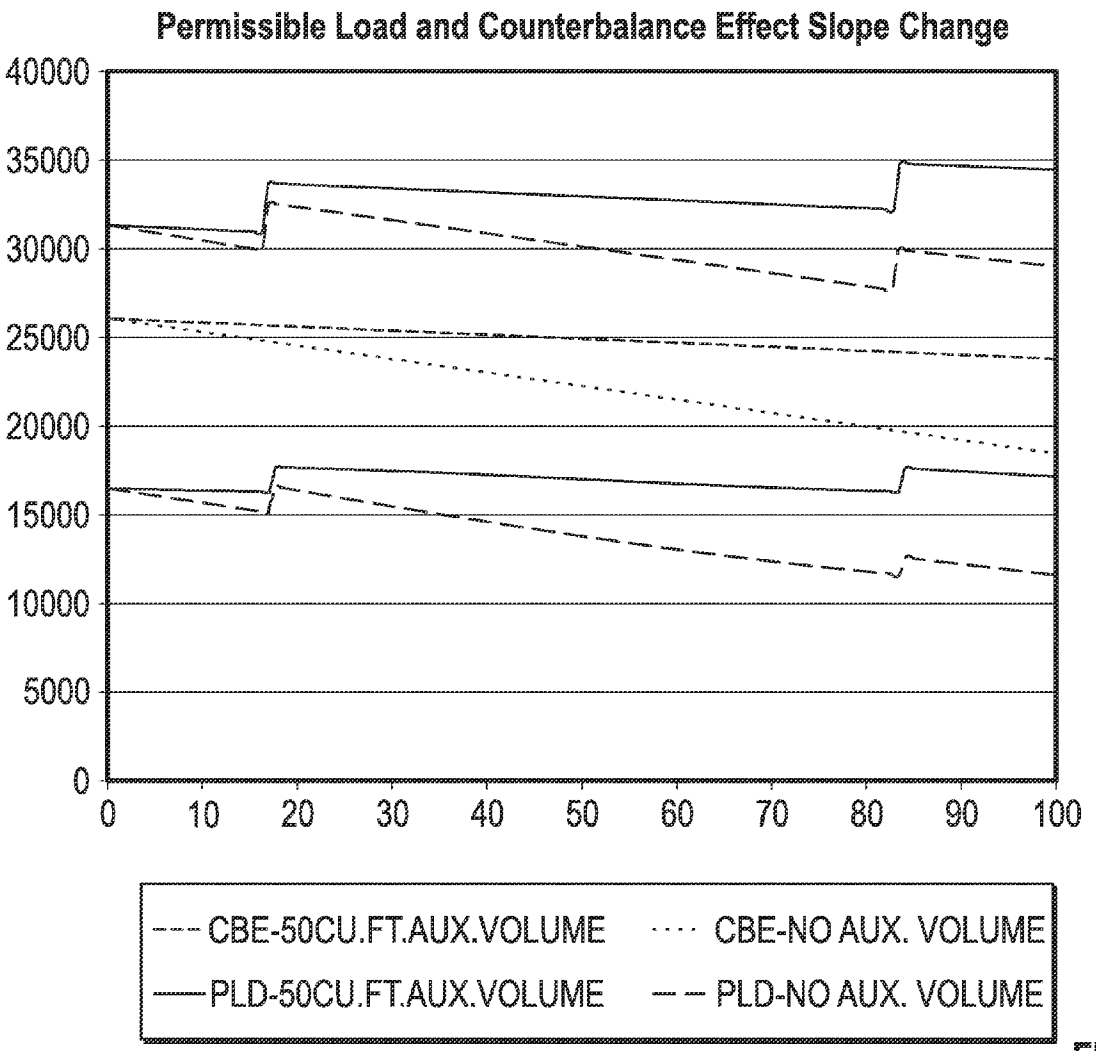
FIG. 13 illustrates a graph presenting exemplary permissible load and counterbalance effect slope changes resulting from an auxiliary pressure vessel partially filled with an incompressible fluid.

Automatically altering slope of the pumping unit permissible load envelope The above equation indicates that pressure inside the vessel system will drop as the compressible volume increases as will occur as the forcer ram of the pumping unit extends. The ratio $V_0/V$ also suggests that varying the overall compressible volume will alter the rate of pressure change as the ram extends and retracts. This will have an effect on the grade of the counterbalance effect force and consequently alter the permissible loading envelope of the pumping unit. The diagram shown in FIG. 13 illustrates alterations in the slope of the permissible load diagram resulting from an auxiliary pressure vessel partially filled with variable amounts of an incompressible liquid intended to control the amount of compressible volume left inside the containment system.

An automated system in which the rod pump controller reads measured well dynamometer data, compares that data to the permissible loading envelope of the pumping unit in its present configuration, and then makes corrective commands to control the pump or valve between the liquid reservoir and the auxiliary pressure vessel to raise or lower liquid level in the vessel has the potential to improve conformity and therefore improve utilization and efficiency of the rod pumping system. This enhancement, paired with an automated means of continually maintaining proper counterbalance (maintaining air pressure within proper limits), provides improved means of adapting the pumping unit system to changing well conditions and protecting system components.

Automatically Correcting Counterbalance

The practice of monitoring motor current (to infer torque) as a means of determining corrective action with regard to counterbalance adjustment has been utilized for many years in pumping unit maintenance. However, due to the largely manual process of making the physical adjustments (adding, removing, or adjusting counterweights) on traditional beam pumping units, an automated method of corrective action has been slow in materializing. Pneumatic or gas spring counterbalance offers an opportunity to make these balancing corrections in an automated fashion on the fly.

Referring again to the FIG. 12 above, the pumping unit motor of the current invention may be controlled and monitored by a variable speed drive (VSD) which in turn exchanges data with the rod pump controller (RPC). Motor current or torque can be monitored and the peak magnitude up-stroke and down-stroke values compared in order to determine whether the pumping unit loading is balanced within acceptable limits. If upstroke torque magnitude is significantly larger than that of the down-stroke, say for example:

$$\frac{|T_{up}| - |T_{down}|}{|T_{up}|} \times 100 > 5\%$$

then the unit is under-balanced. In this instance the RPC can activate the make-up air compressor to inject additional air mass into the pressure vessel system until the out of balance condition is alleviated. If the reverse is detected, that is $$\frac{|T_{up}| - |T_{down}|}{|T_{up}|} \times 100 < -5\%$$

and the unit is overbalanced, the RPC can activate an electrically actuated bleed valve and vent air mass from the pressure vessel until proper balance is re-established.

Basic Control Sequence

Figure 14:
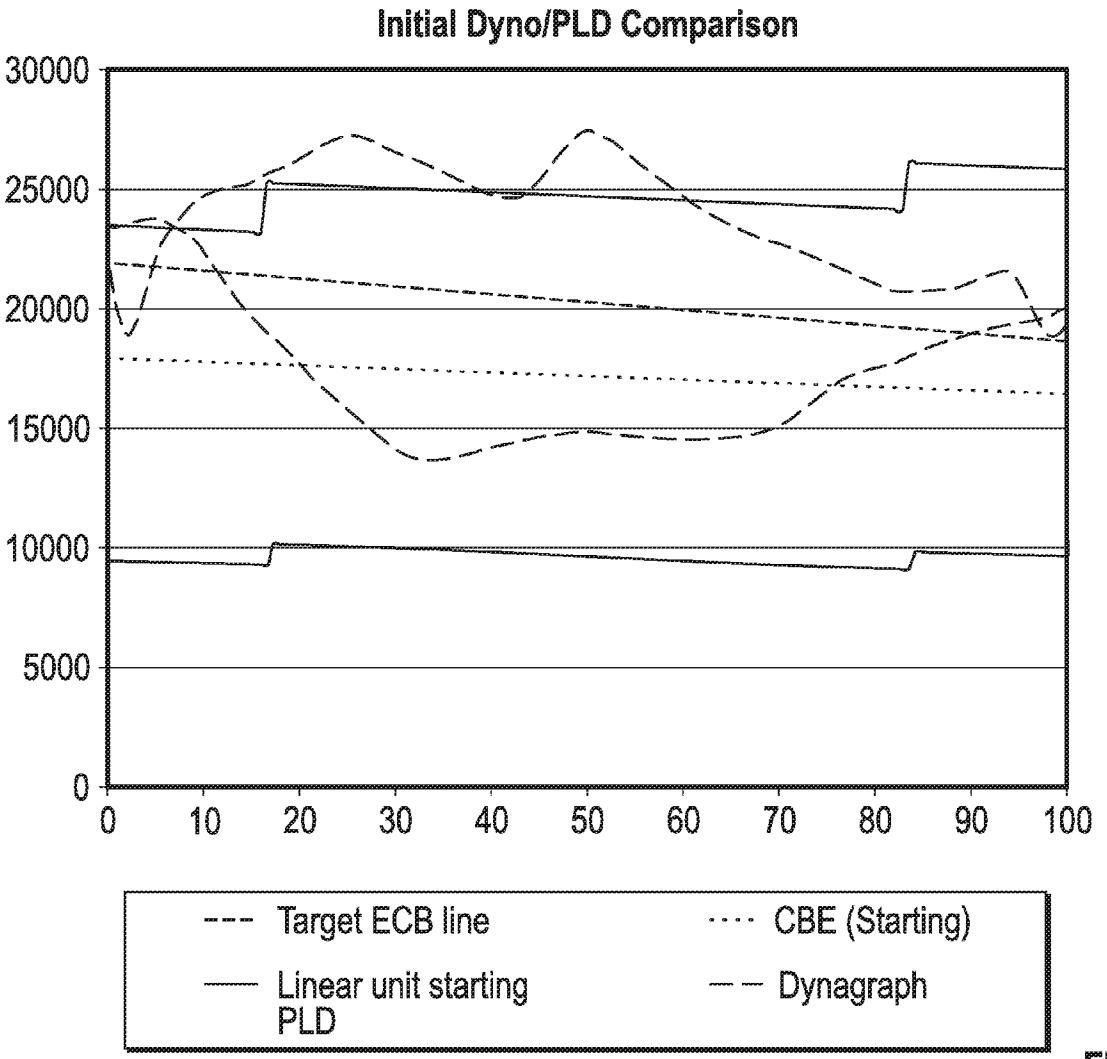
FIG. 14 illustrates an initial dynagraph derived from a rod pump controller in association with a system of the present disclosure.
Figure 15:
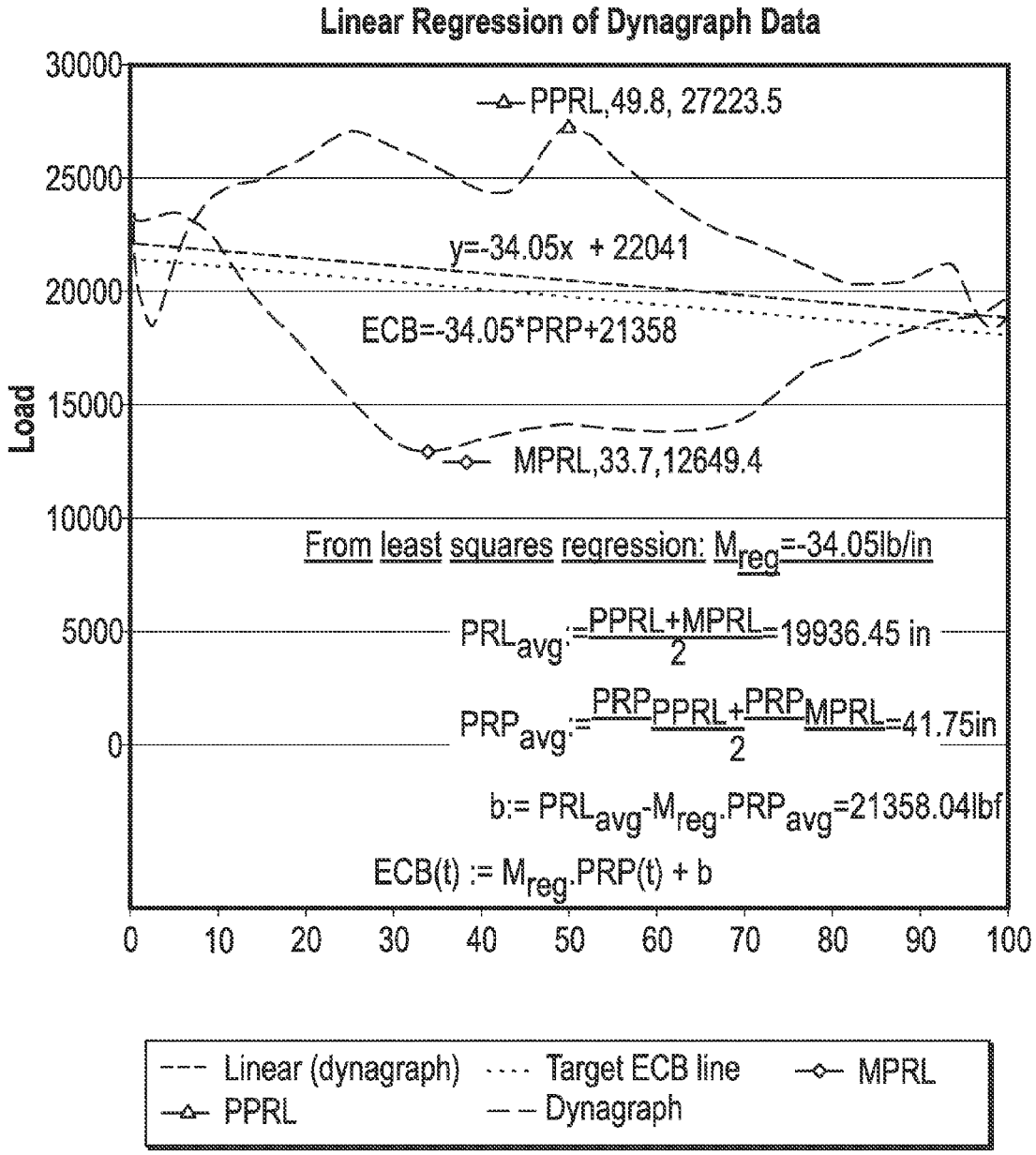
FIG. 15 illustrates an exemplary linear regression model of dynagraph data in accordance with aspects of the present disclosure.
Figure 16:
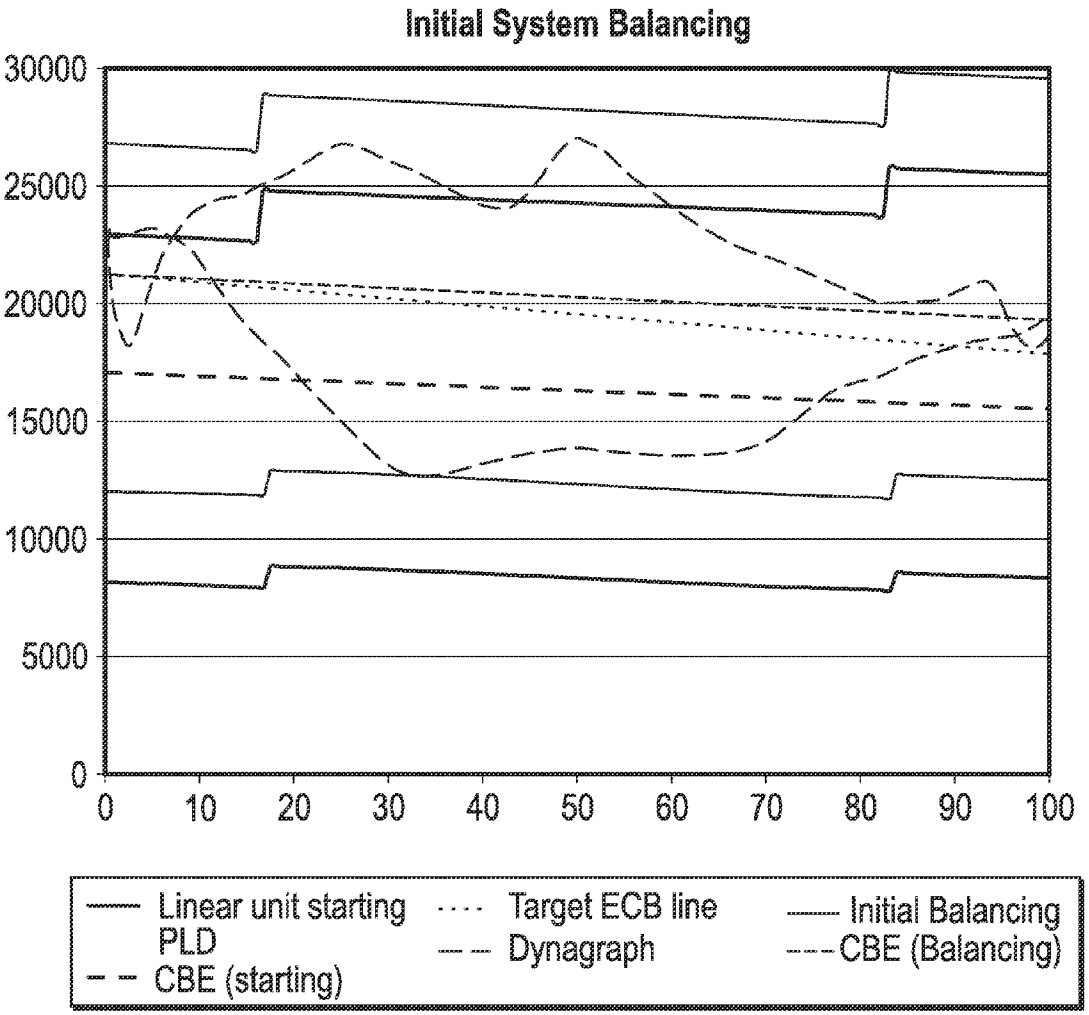
FIG. 16 illustrates an exemplary dynagraph after an initial system balancing sequence in accordance with the present disclosure.
Figure 17:
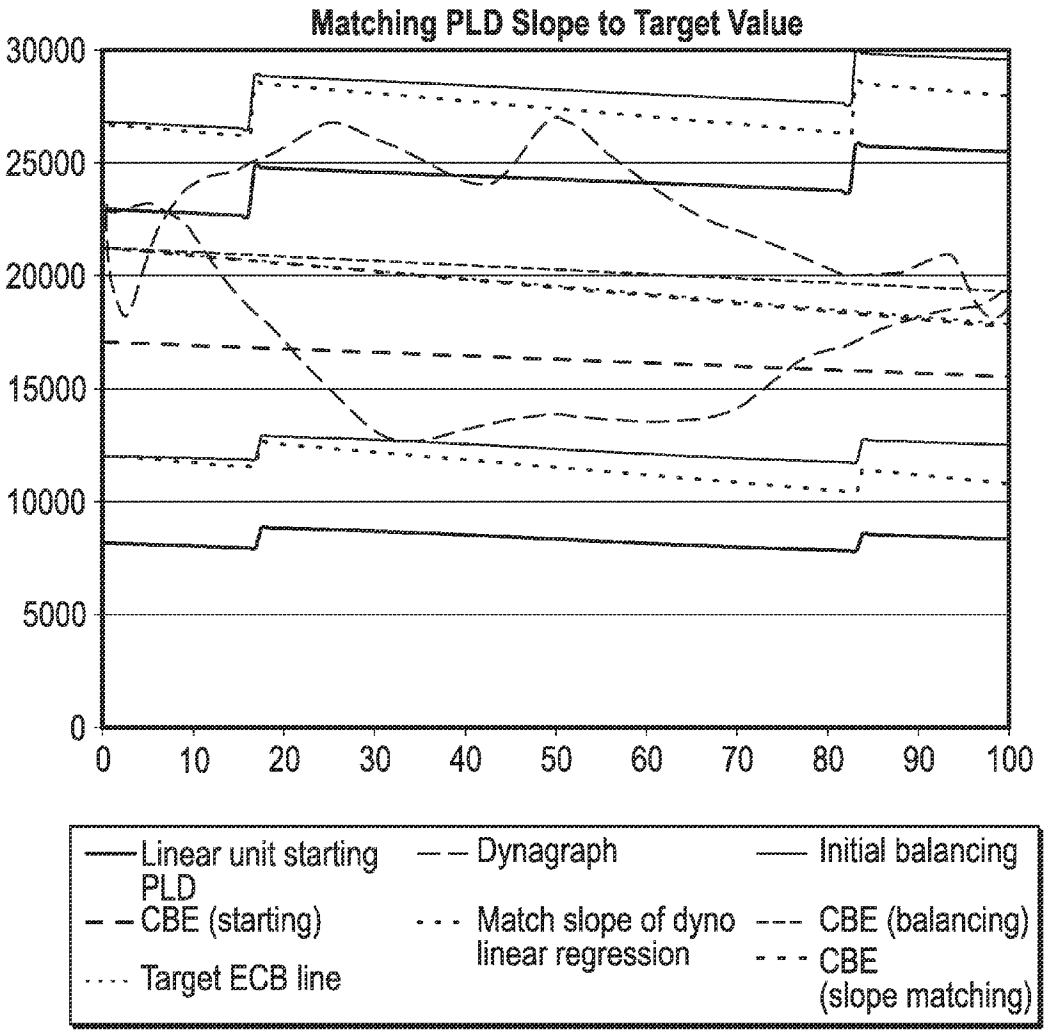
FIG. 17 illustrates a general graph matching PLD (permissible slope diagram) slope to a target value, in accordance with aspects of the present disclosure.
Figure 18:
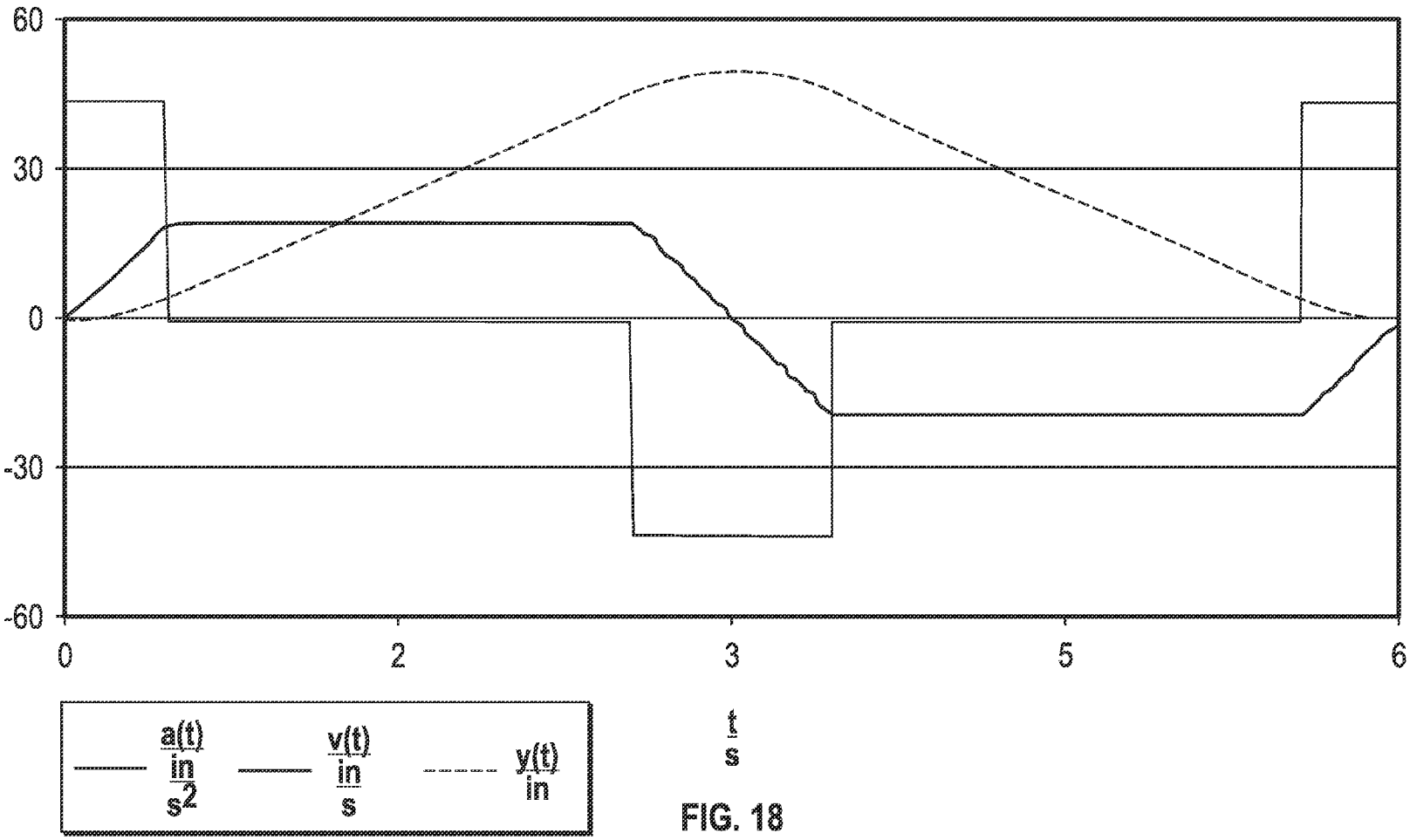
FIG. 18 illustrates an exemplary cycle time interval in accordance with the present disclosure.
Figure 19:
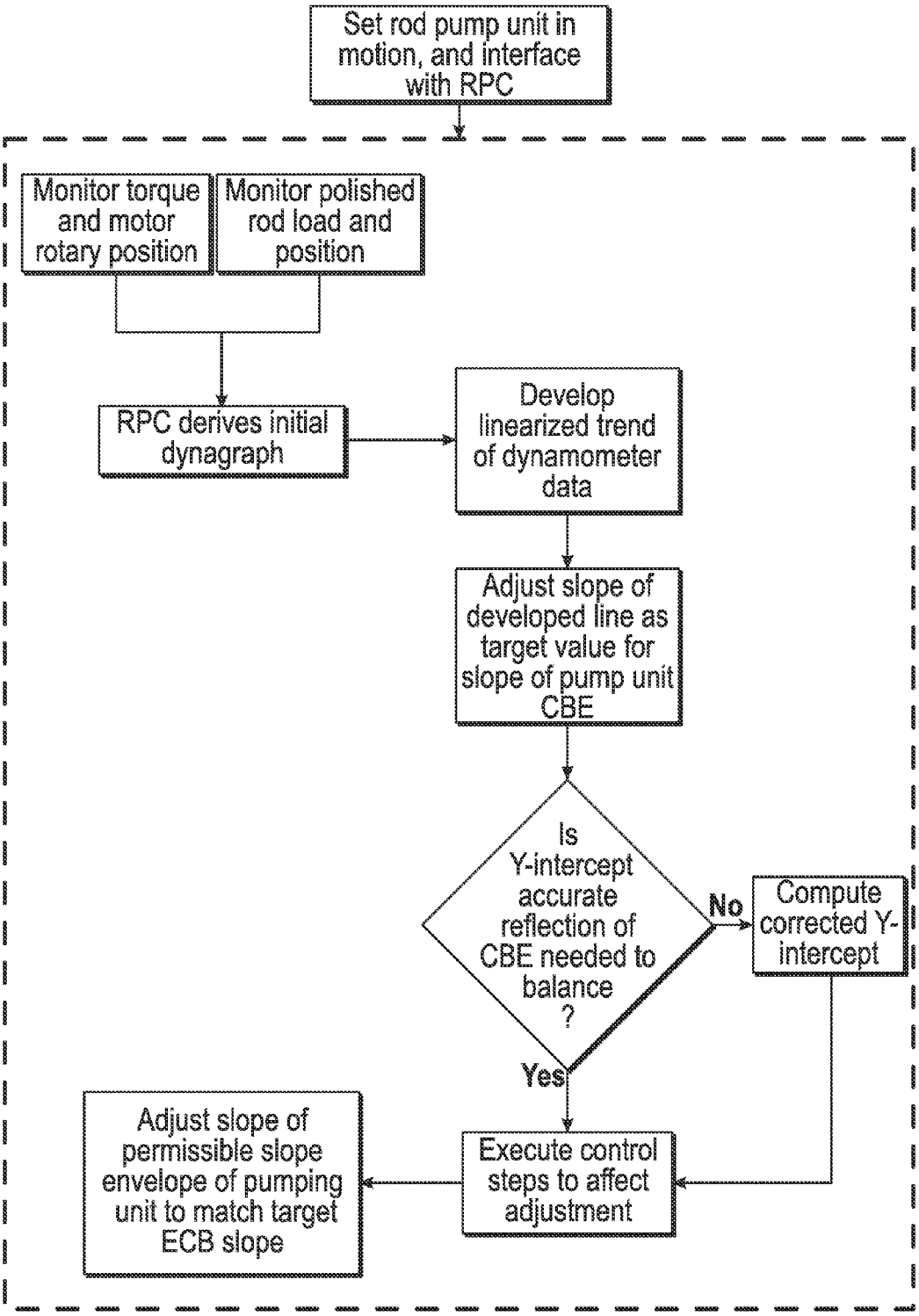
FIG. 19 illustrates a general flowchart of steps for methods of controlling rod string motion and/or force using the systems of the present disclosure.

The example below, and shown schematically in FIG. 19, illustrates a potential scenario in which a rod pumping system of the present disclosure incorporating the current pumping unit invention along with the enhancements for controlling counterbalance and permissible loading envelope slope is utilized to actively control rod string motion and/or force, wherein the pumping unit is characterized as having low inertia. In this scenario, the pumping unit is initially set in motion interfaced with a well application and is only crudely adjusted to meet its optimization needs. Through monitoring torque and motor rotary position or alternatively, polished rod load and position, the rod pump controller (RPC) can derive a dynagraph as illustrated generally in FIG. 14.

The linearized trend of the dynamometer data can then be developed through linear regression methods, such as "least squares", or similar mathematical applications. The slope of this line can then be adopted as a target value for the slope of the pumping unit's counterbalance effect. The "y intercept" of the regression line, however may not consistently reflect the "bottom dead center" counterbalance effect needed to balance with respect to the peak and minimum polished rod loads. A corrected y-intercept may be computed by projecting a line from the average of the peak and minimum loads along the slope from the regression analysis to the zero polished rod position axis according to:

$$b := \mathrm{PRL}_{avg} - M_{reg} \cdot \mathrm{PRP}_{avg} = 213581\,bf$$

With the target counterbalance effect (CBE) line defined, a sequence of control steps can then be executed to affect the proper adjustments. The first of these is to set the maximum pressure inside the pressure vessel system. The y-intercept in the target CBE line serves for this purpose. The maximum pressure inside the system will occur at the bottom of the ram stroke, which coincides with the zero polished rod position. Using the value of the y-intercept to calculate maximum system pressure according to $$P_{mx} = \frac{8 \cdot b + 4 \cdot w_{assy}}{\pi \cdot d_{oram}^2} = 333.36\ psi,$$

the rod pump controller (RPC) can compare measured peak pressure to the newly-calculated "desired" peak pressure and either activate the system's air compressor or electrically controlled bleed valve to bring the system pressure to within acceptable limits.

Having adjusted the peak pressure in the system, the slope of the permissible load envelope of the pumping unit can be adjusted to match the target estimated counterbalance (ECB) slope by adding or removing liquid from the pressure vessel. The needed compressible volume in the auxiliary tank to establish this slope can be calculated from $$V_{xt} := \frac{8 \cdot V_b - \left(\frac{4 \cdot W_{assy} + 8 \cdot b + 8 \cdot M_{reg} \cdot PRP(t_d)}{\pi \cdot P_{max} \cdot d_{oram}^2}\right)^{\frac{1}{k}} \cdot \begin{pmatrix} 2 \cdot \pi \cdot d_{igt}^2 \cdot h_{tank} - 2 \cdot \pi \cdot d_{ogt}^2 \cdot h_{tank} - \\ 2 \cdot \pi \cdot d_{oram}^2 \cdot h_{tank} \ldots + 2 \cdot \pi \cdot d_{itank}^2 \cdot h_{tank} - \\ 2 \cdot \pi \cdot d_{screw}^2 \cdot h_{tank} - 2 \cdot \pi \cdot d_{tb}^2 \cdot 1_{tb} - \\ 2 \cdot \pi \cdot d_{nut}^2 \cdot 1_{nut} \ldots + 2 \cdot \pi \cdot d_{iram}^2 \cdot l_{ram} + \\ 2 \cdot \pi \cdot d_{oram}^2 \cdot y_b + \pi \cdot PRP(t_d) \cdot SL \cdot d_{oram}^2 \end{pmatrix}}{8\left(\frac{4 \cdot W_{assy} + 8 \cdot b + 8 \cdot M_{reg} \cdot PRP(t_d)}{\pi \cdot P_{max} \cdot d_{oram}^2}\right)^{\frac{1}{k}} - 8}$$

$$= 29.97\ \mathrm{ft}^3$$

Where:

$V_b$=Compressible volume in the primary pressure vessel at bottom of stroke.

$W_{assy}$=Weight of overhead components such as wireline, ram, drums, etc. supported by the screw and counterbalance forces.

b=Y-intercept of target ECB (estimated counterbalance) line.

$M_{reg}$=Slope of target ECB (estimated counterbalance) line.

PRP=Polished rod position $t_d$=Time interval to complete up-stroke.

$P_{max}$=Maximum pressure in containment vessel system. Occurs at bottom of stroke.

$d_{oram}$=Outer diameter of forcer ram tube.

$d_{iram}$=Inner diameter of forcer ram tube.

$l_{ram}$=length of forcer ram tube.

$d_{igt}$=Inside diameter of guide tube.

$h_{tank}$=Vertical height of the contained cylindrical volume in the primary pressure vessel.

$d_{ogt}$=Outside diameter of guide tube.

$d_{itank}$=Inside diameter of pressure vessel shell.

$d_{screw}$=Pitch diameter of roller screw thread.

$d_{tb}$=Diameter of thrust bearing.

$l_{tb}$=Length of thrust bearing.

$d_{nut}$=Diameter of roller nut.

$l_{nut}$=Length of roller nut.

$y_b$=Lower face of ram location at bottom of stroke.

SL=Polished rod stroke length.

Depending upon the displaced volume of actuator and other components within the primary pressure vessel. The needed liquid volume can be calculated by subtracting the above amount from the total auxiliary vessel volume.

Of course, as liquid is added or removed from the system, the pressure inside the vessel will vary somewhat inversely to the remaining compressible volume. The RPC (rod pump controller) will continuously monitor and control the air pressure to maintain it within limits during liquid addition or removal.

Active Control of Pumping Unit Speed

The work performed by the pumping unit in one cycle can be very nearly approximated by the area captured within the dynamometer card according to:

$$\mathrm{WORK} = \int F_{dyno} \times d\mathrm{PRP}$$

Even with proper counterbalance and permissible load envelope slope matching, the dynamometer card produced in a rod pumping application is still very much a product of the force and motion interactions between the pumping unit, the downhole pump, and the connecting sucker rod string. The permissible loading diagram shown above may still not conform particularly well to the dynamometer card despite efforts to correct counterbalance and CBE slope. It should be noted though that the motion profile used to derive the above PLD was very simplistic comprised of 2 periods of constant acceleration to ramp polished rod speed up and down over approximately 30% of the cycle time interval. The remaining 70% of the cycle time interval is spent at constant speed. This explains the steps in permissible load near the top and bottom of the stroke. However, the duration of the ramping accelerations need not be held to a fixed time interval. They need not even be constrained as constant acceleration periods. The benefit of a low inertia pumping unit mechanism, such as that of the present invention, is that speed changes can be made within the pumping cycle without burning through excessive amounts of energy. Ramping slowly to a somewhat higher polished rod velocity can still allow a cycle to complete in the 6 seconds needed to operate the machine at 10 SPM (strokes per minute).

Speed manipulation can have an effect on the shape of the dynamometer card as well. When comparing the dynamometer data to the permissible load diagram, if it is observed that the applied load pulls away from the permissible load value such that the unit's capacity is being underutilized, it could prove beneficial that the RPC command a slight speed increase through that region. That is, provided that the speed increase does not instigate an issue such as rod buckling or another problem. The predictive simulation capabilities of many rod pump controllers today allows trial scenarios to be derived and modeled prior to implementing them such that most such issues can be avoided.

The benefits of the systems and methods of the present invention are clear in view of the present disclosure. That is, the mechanism of the pumping unit of the present invention combines a compressed gas or pneumatic spring for counterbalance with a linear roller screw assembly to create and control lifting forces and motion necessary to operate the downhole pump of a pumping unit. Further, the moving portions of the pumping unit mechanism possess relatively low mass and mass movements of inertia as compared to traditional beam unit designs, and as such, provide little inertial resistance to spee changes as needed for well optimization. With such low inertia, the ram's motion profile can be varied quickly, using a well controller or the like, to reduce rod loading, improve work capacity utilization, improve pump fillage, or mitigate rod fall issues associated with production of heavy oil.

The pumping unit assembly of the present disclosure also achieves a low vertical height profile through a method of stroke length multiplication involving drums deployed at the end of the forcer ram and a wireline anchored to a fixed ground point on one end, while being wrapped over the sheaves and connected to the well polished rod (via the carrier bar) on the opposite side. The on-site environmental impact of the machine is consequently very slight. That is, the instant pumping unit system has a small size with respect to traditional beam pumping units with equivalent lifting capacity. The system further exhibits a generally 'monolithic' appearance with few observable moving parts, particularly at ground level, which results in a significant reduction in ground level safety hazards, and may require little or no safety guarding except around the well head.

Further, as described in detail herein, the counterbalance for the pumping unit system of the present invention is provided by a gas-spring type of assembly, which offers a number of advantages over the typical, mass-based counterbalance unit assemblies, including but not limited to allowing for counterbalance adjustment automatically by controlling the gas pressure; allowing a rod pump controller to monitor pumping unit motor torque and provide balancing pressure correction commands to a gas compressor or bleed valve depending on the optimization needed; and, allowing for a reduction in the weight and material consumption relating to the manufacturing and shipping of the pumping unit. In addition, given that the stroke length of the pumping unit assembly described herein is not constrained by a fixed geometry linkage system such as that found in typical beam-type pumping units, the stroke length can be adjusted or varied on the fly. That is, down-hole pump spacing can be monitored for evidence of gas lock or tagging, and corrections can be made automatically. System self diagnostics such as valve checks can also be readily performed automatically via rod pump controller integration.

Yet another benefit of the pump unit systems and methods of use of the present invention is the ready application of adaptive noise cancellation. As is well understood in the art, the sucker rod oscillates at a certain harmonic frequency during operation, resulting in rod fatigue issues directly associated with the noise. With the instantly described pump unit system, one or more phase-shifts may be included, such as within the well controller, to attenuate and cancel the sucker rod oscillation frequencies.

Other and further embodiments utilizing one or more aspects of the inventions described above can be devised without departing from the spirit of Applicant's invention. For example, a series of auxiliary pressure vessels in fluid communication with each other may be used in a pumping unit in accordance with the present disclosure. Further, the various methods and embodiments of the methods of manufacture and assembly of the system, as well as location specifications, can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A device for actuating a rod of a sucker rod pump assembly, the device comprising:

a motor;

a linear actuator assembly operatively connected to the motor, wherein the linear actuator assembly is not a fixed geometry linkage system; and a counterbalance assembly operatively connected to the linear actuator assembly capable of alleviating a load imposed on the linear actuator assembly by the rod and a column of a first fluid to be pumped, wherein the counterbalance assembly includes a containment vessel.

2. The device of claim 1, wherein the linear actuator assembly includes a rotating screw mechanism.

3. The device of claim 2, wherein the rotating screw mechanism is a planetary roller screw mechanism.

4. The device of claim 2, wherein the linear actuator assembly is capable of adjusting the stroke length of the rod includes adjusting the stroke length of the rod automatically.

5. The device of claim 1, wherein the linear actuator assembly is capable of adjusting the stroke length of the rod.

6. The device of claim 1, wherein the linear actuator assembly is capable of adjusting the stroke length of the rod includes adjusting the stroke length in response to evidence of gas lock or tagging.

7. The device of claim 1, wherein the motor is capable of being controlled as a variable speed drive.

8. The device of claim 1, wherein the linear actuator assembly is substantially vertically oriented.

9. A method of pumping a fluid utilizing a sucker rod assembly, the sucker rod assembly comprising a rod, a pumping unit, and a counterbalance assembly, the method comprising:

positioning the pumping unit such that a linear axis of operation is substantially parallel with the axis of movement of the sucker rod;

providing the counterbalance assembly that includes at least one pressure vessel positioned such that the at least one pressure vessel substantially alleviates the load imposed on the pumping unit by the sucker rod and a column of fluid to be pumped;

wherein the at least one pressure vessel contains a substance; and adjusting the stroke length of the rod.

10. The method of claim 9, wherein the pumping unit includes a rotating screw mechanism.

11. The method of claim 9, wherein adjusting the stroke length of the rod includes adjusting the stroke length automatically.

12. The method of claim 9, further comprising maintaining a constant mass of the substance in the at least one pressure vessel.

13. The method of claim 9, wherein adjusting the stroke length of the rod includes adjusting the stroke length in response to evidence of gas lock or tagging.

14. A device for lifting of a fluid, the device comprising:

a pumping unit, wherein the pumping unit includes a linear actuator assembly, wherein the pumping unit is not a fixed geometry linkage system; and a counterbalance assembly operatively connected to the pumping unit capable of alleviating the load imposed on a rod of a sucker rod pump assembly and a column of fluid to be pumped from a subterranean well, wherein the counterbalance assembly includes a containment vessel.

15. The device of claim 14, wherein the linear actuator assembly includes a rotating screw mechanism.

16. The device of claim 15, further the pumping unit is capable of adjusting the stroke length of the rod includes pumping unit is capable of adjusting the stroke length of the rod automatically.

17. The device of claim 14, wherein the pumping unit is capable of adjusting the stroke length of the rod.

18. The device of claim 14, wherein the pumping unit is capable of adjusting the stroke length of the rod includes adjusting the stroke length of the rod in response to evidence of gas lock or tagging.

19. The device of claim 18, wherein the auxiliary control assembly is capable of changing a volume of a substance in the pressure vessel.

20. The device of claim 14, wherein the linear actuator assembly is substantially vertically oriented.

* * * * *